US008929774B2

(12) United States Patent
Katoh et al.

(10) Patent No.: US 8,929,774 B2
(45) Date of Patent: Jan. 6, 2015

(54) BELT UNIT AND IMAGE FORMING APPARATUS EMPLOYING SAME

(75) Inventors: Tsutomu Katoh, Kanagawa (JP); Yohhei Watanabe, Kanagawa (JP); Yuji Kato, Kanagawa (JP); Yoshihisa Watanabe, Kanagawa (JP); Hajime Teraji, Kanagawa (JP); Arinobu Yoshiura, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 431 days.

(21) Appl. No.: 13/312,596

(22) Filed: Dec. 6, 2011

(65) Prior Publication Data

US 2012/0148300 A1 Jun. 14, 2012

(30) Foreign Application Priority Data

Dec. 9, 2010 (JP) ..... 2010-274441
Dec. 9, 2010 (JP) ..... 2010-274444

(51) Int. Cl.
*G03G 15/08* (2006.01)
*G03G 15/00* (2006.01)
*G03G 15/16* (2006.01)

(52) U.S. Cl.
CPC .... *G03G 15/1615* (2013.01); *G03G 2215/0129* (2013.01)
USPC ..... 399/121; 399/165

(58) Field of Classification Search
USPC ..... 399/121, 165, 302, 308, 313; 198/813
See application file for complete search history.

(56) References Cited

U.S. PATENT DOCUMENTS

| | | | | |
|---|---|---|---|---|
| 5,950,062 | A | 9/1999 | Yahata et al. | |
| 7,158,730 | B2 | 1/2007 | Watanabe et al. | |
| 7,274,897 | B2 | 9/2007 | Katoh | |
| 7,302,208 | B2 | 11/2007 | Tsuda et al. | |
| 7,493,061 | B2 | 2/2009 | Hatori et al. | |
| 7,499,665 | B2 | 3/2009 | Kuma et al. | |
| 7,509,073 | B2 | 3/2009 | Katoh et al. | |
| 7,522,850 | B2 | 4/2009 | Watanabe et al. | |
| 7,599,651 | B2 * | 10/2009 | Kitagawa et al. | 399/302 |

(Continued)

FOREIGN PATENT DOCUMENTS

| | | | |
|---|---|---|---|
| CN | 1904760 | A | 1/2007 |
| JP | H08-069238 | A | 3/1996 |

(Continued)

OTHER PUBLICATIONS

Chinese Office Action dated Apr. 28, 2014 issued in corresponding Chinese Application No. 201110412065.3 (no English translation).

(Continued)

*Primary Examiner* — Billy Lactaoen
(74) *Attorney, Agent, or Firm* — Harness, Dickey & Pierce, P.L.C.

(57) ABSTRACT

A belt unit is detachably attached to a housing. A holder changes a state of an endless belt by moving a transfer roller between a first state as an endless belt movement state and a second state as a detachment state. The first state allows the endless belt to circulate for image formation, and the second state allows the belt unit to be detached from the housing. The holder moves the transfer roller adjacent supporter independently of the transfer roller and lifts the opening in the endless belt to a prescribed position to expose it to the front side plate.

17 Claims, 13 Drawing Sheets

(56) References Cited

U.S. PATENT DOCUMENTS

| | | | |
|---|---|---|---|
| 7,609,998 | B2 | 10/2009 | Katoh et al. |
| 7,627,268 | B2 | 12/2009 | Katoh et al. |
| 7,848,692 | B2 | 12/2010 | Saeki et al. |
| 7,885,588 | B2 | 2/2011 | Katoh et al. |
| 7,899,386 | B2 | 3/2011 | Saeki et al. |
| 7,933,546 | B2 | 4/2011 | Fukao et al. |
| 2005/0169667 | A1 | 8/2005 | Katoh |
| 2006/0045570 | A1 | 3/2006 | Kato et al. |
| 2006/0045603 | A1 | 3/2006 | Hatori et al. |
| 2006/0067746 | A1 | 3/2006 | Okazaki |
| 2006/0210307 | A1 | 9/2006 | Katoh et al. |
| 2006/0210324 | A1 | 9/2006 | Kuma et al. |
| 2006/0284958 | A1 | 12/2006 | Saeki et al. |
| 2007/0025762 | A1 | 2/2007 | Kato et al. |
| 2007/0071499 | A1 | 3/2007 | Watanabe et al. |
| 2007/0098472 | A1 | 5/2007 | Saeki et al. |
| 2007/0127947 | A1 | 6/2007 | Kuma et al. |
| 2007/0127955 | A1 | 6/2007 | Katoh et al. |
| 2007/0248391 | A1 | 10/2007 | Yokokawa et al. |
| 2007/0286640 | A1 | 12/2007 | Katoh et al. |
| 2008/0145102 | A1 | 6/2008 | Katoh et al. |
| 2008/0175619 | A1 | 7/2008 | Katoh et al. |
| 2009/0110436 | A1 | 4/2009 | Sugiyama |
| 2009/0169236 | A1 | 7/2009 | Fukao et al. |
| 2009/0279906 | A1 | 11/2009 | Kuma et al. |
| 2009/0317104 | A1 | 12/2009 | Katoh et al. |
| 2010/0040386 | A1 | 2/2010 | Mizutani et al. |
| 2010/0061752 | A1 | 3/2010 | Sudo et al. |
| 2010/0303485 | A1 | 12/2010 | Watanabe |
| 2011/0103862 | A1 | 5/2011 | Saeki et al. |
| 2011/0222938 | A1 | 9/2011 | Watanabe et al. |
| 2011/0305488 | A1* | 12/2011 | Kikuno ..... 399/312 |

FOREIGN PATENT DOCUMENTS

| | | | |
|---|---|---|---|
| JP | 3033512 | U | 1/1997 |
| JP | 09-236993 | A | 9/1997 |
| JP | 2002-108045 | A | 4/2002 |
| JP | 2003-216001 | | 7/2003 |
| JP | 2003-216001 | A | 9/2003 |
| JP | 2004-302375 | A | 10/2004 |
| JP | 2006-098538 | A | 4/2006 |
| JP | 2006-151697 | A | 6/2006 |
| JP | 2007-304500 | A | 11/2007 |
| JP | 2008-026453 | A | 2/2008 |
| JP | 2009-020238 | A | 1/2009 |
| JP | 2009-031718 | A | 2/2009 |
| JP | 2009-063678 | A | 3/2009 |
| JP | 2009-092806 | A | 4/2009 |
| JP | 2009-251089 | A | 10/2009 |
| JP | 2010-217430 | A | 9/2010 |
| JP | 2010-217528 | A | 9/2010 |

OTHER PUBLICATIONS

Japanese Office Action dated Aug. 22, 2014 issued in corresponding Japanese Application No. 2010-274441.

Japanese Office Action dated Sep. 5, 2014 issued in corresponding Japanese Application No. 2010-274444.

* cited by examiner

BELT UNIT AND IMAGE FORMING APPARATUS EMPLOYING SAME

CROSS-REFERENCE TO RELATED APPLICATIONS

This patent application is based on and claims priority pursuant to 35 U.S.C. §119 to Japanese Patent Application Nos. 2010-274441 and 2010-274444, both filed on Dec. 9, 2010 in the Japan Patent Office, the entire disclosures of which are hereby incorporated by reference herein.

FIELD OF THE INVENTION

The present invention relates to a belt unit capable of supporting and circulating an endless belt using multiple supporting members provided within a loop of the endless belt, and an image forming apparatus employing the belt unit.

BACKGROUND OF THE INVENTION

An image forming apparatus that employs a belt unit having an endless belt and multiple belt supporting members support and circulate the endless belt in a loop is known, as disclosed in Japanese Patent Application Publication No. 2003-216001 (JP-2003-216001-A). Specifically, the image forming apparatus of JP-2003-216001-A includes four photoconductors that respectively form toner images of yellow, magenta, cyan, and black component colors. The image forming apparatus of JP-2003-216001-A also includes a belt-type transfer unit that transfers these toner images and forms a full-color toner image by superimposing these yellow, magenta, cyan, and black toner images from the four photoconductors onto a surface of an endless intermediate transfer belt provided in the transfer unit using a known electrophotographic process. The transfer unit can switch the degree of tension on the endless intermediate transfer belt at least between a taut use state for actual image formation and loose detachment state. The use state enables the intermediate transfer belt to circulate while remaining in contact with one or more photoconductors to form an image. The detachment state enables the intermediate transfer belt to be separated from all four of the photoconductors to allow a user to pull the transfer unit out of the image forming apparatus.

More specifically, primary transfer rollers for yellow, magenta, cyan, and black are supported by a frame unit to sandwich the intermediate transfer belt and form transfer nips thereon with the yellow, magenta, cyan, and black photoconductors, respectively. Then, by moving the frame unit, accordingly the yellow, magenta, cyan, and black primary transfer rollers, the intermediate transfer belt previously contacting the yellow, magenta, cyan, and black photoconductors separates therefrom. The transfer unit can then be readily pulled out, thereby facilitating maintenance thereof.

However, in such an image forming apparatus, ease of maintenance of the primary transfer rollers on the transfer unit pulled out from the housing has been almost neglected. That is, in general, to maintain the yellow, magenta, cyan, and black primary transfer rollers arranged within the loop of the endless intermediate transfer belt, these rollers need to be detached and removed from the loop thereof. Thus, an operator needs to insert his or her hand into an opening formed in both lateral sides of the intermediate transfer belt. However, such an opening is generally covered by a side plate which supports the multiple belt support rollers at both longitudinal ends. With such a configuration, since insertion of the hand into the belt loop is difficult and the primary transfer rollers are hardly visible within the belt loop, as a practical matter the primary rollers cannot be detached in such a state. Accordingly, the intermediate transfer belt is generally detached from the transfer unit prior to detachment of the primary rollers to provide ready access thereto, requiring extraordinary time and effort.

Even in such a situation, the system described below can be employed to solve such a problem. That is, four rollers supporting the intermediate transfer belt are independently movably disposed in the vicinity of the primary transfer rollers for yellow, magenta, cyan, and black component in the transfer unit, respectively. Typically, when a yellow primary transfer roller is to be maintained, for example, the operator executes the following operations. Initially, he or she pulls the transfer unit out from the housing. Then, he or she reduces the tension of the intermediate transfer belt on the transfer unit by sliding tension roller or the like, for example. Subsequently, he or she displaces one of the four belt rollers arranged in the vicinity of the yellow transfer roller from the inside to the outside of the belt loop so that the opening of the belt is pushed up to be exposed from the side plate in the vicinity of the yellow transfer roller. Hence, he or she can at last access the yellow transfer roller via the opening of the belt now pushed up in this way. The same goes for each of the remaining component transfer rollers. Accordingly, the primary transfer rollers of the respective colors can to some extent be maintained, although such a configuration employing dedicated rollers increases cost.

BRIEF SUMMARY OF THE INVENTION

Accordingly, the present invention provides a novel belt unit detachably attached to a housing of an image forming apparatus. The belt unit includes an endless belt stretched in a looped state having openings in both lateral sides. The belt unit also includes a holder that holds multiple belt supporters between front and rear side plates within the loop of the endless belt to stretch and support the endless belt. The multiple belt supporters include a transfer roller to apply a transfer bias to a rear side surface of the endless belt and transfer a toner image borne on a surface of an image bearer provided in the image forming apparatus onto one of a surface of the endless belt and a recording medium held by the endless belt. The multiple belt supporters also include an adjacent transfer roller provided adjacent to the transfer roller to independently move from the transfer roller. The holder changes a tension of the endless belt by moving the transfer roller between a first state and a second state. The first state allows the endless belt to circulate for image formation. The second state allows the belt unit to be detached from the housing. The holder is configured to move the transfer roller adjacent supporter independently of the transfer roller and lifts the opening of the endless belt to a prescribed position to expose it to the front side plate as a third state.

In another aspect, a drawer is provided to slidably draw the holder from the housing.

In yet another aspect, the multiple belt supporters include a skew corrector that corrects skew of the endless belt. The skew corrector is arranged not parallel to any other one of the multiple belt supporters.

In yet another aspect, the third state serves as a transfer roller detachment and attachment state that enables detachment and attachment of the transfer roller to and from the loop of the endless belt and upgrades thereof.

In yet another aspect, tension roller is detachably attached to the belt unit to provide tension to a front surface of the endless belt from outside the loop. The third state is created by detaching the tension roller from the belt unit and decreasing the tension of the endless belt and partially lifting the endless belt with the transfer roller adjacent supporter from an inside to an outside of the loop thereof to expose the transfer roller to improve visibility and accessibility of the transfer roller in the loop.

In yet another aspect, the multiple belt supporters include interior parts. The holder provides a fourth state allowing detachment and attachment of the interior parts from and to the loop of the endless belt is created by detaching the tension roller from the belt unit and decreasing the tension of the endless belt while partially lifting the endless belt from an inside to an outside of the loop thereof to expose the interior parts to improve visibility and accessibility to the interior parts in the loop of the belt.

In yet another aspect, the holder independently movably holds the transfer roller adjacent supporter and provides a fifth state allowing detachment and attachment of the endless belt from and to the belt unit so that performance of the detachment and attachment of the endless belt is better than those obtained from the first to third postures.

In yet another aspect, the holder movably holds multiple transfer roller adjacent supporters independently of multiple transfer rollers. The fifth state is created by detaching the multiple tension rollers from the belt unit and decreasing the tension of the endless belt while partially lifting the endless belt at multiple positions thereof by moving the multiple transfer roller adjacent supporters from an inside to an outside of the loop thereof to improve performance of the detachment and attach of the endless belt from and to the belt unit.

In yet another aspect, an image forming apparatus includes an image formation device that forms an image on a recording medium and the belt unit as described above.

BRIEF DESCRIPTION OF THE DRAWINGS

A complete appreciation of the present invention and many of the attendant advantages thereof will be more readily obtained as the same becomes better understood by reference to the following detailed description when considered in connection with the accompanying drawings, wherein.

DETAILED DESCRIPTION OF THE INVENTION

Figure 1:
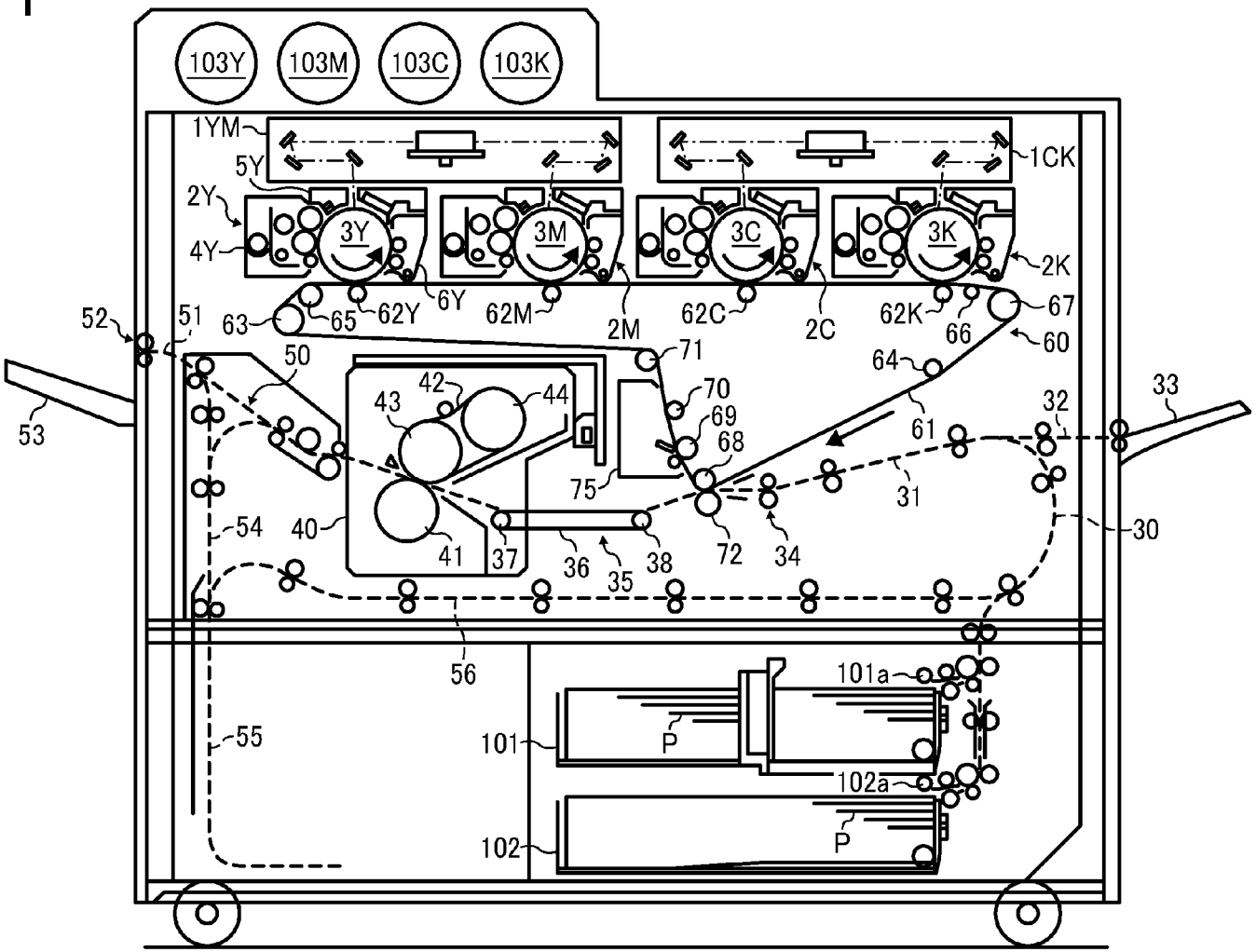
FIG. 1 is a front elevational view and schematically illustrates a printer according to one embodiment of the present invention.
Figure 2:
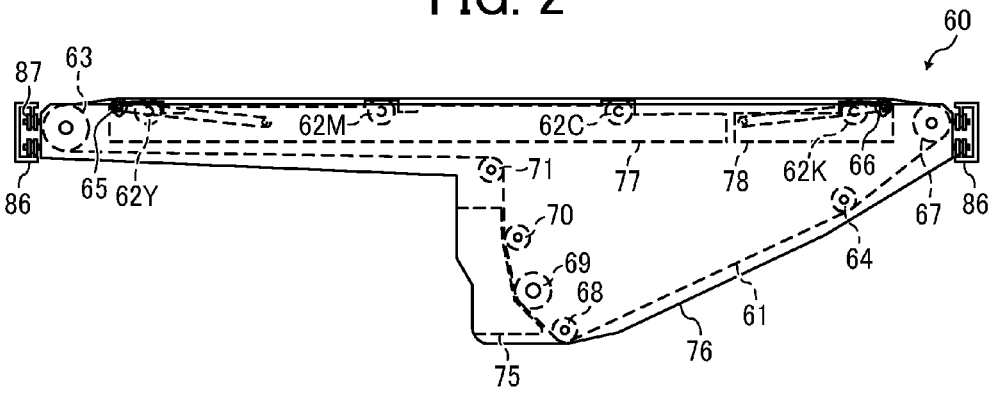
FIG. 2 is a front elevational view of a transfer unit included in the printer of FIG. 1.
Figure 6:
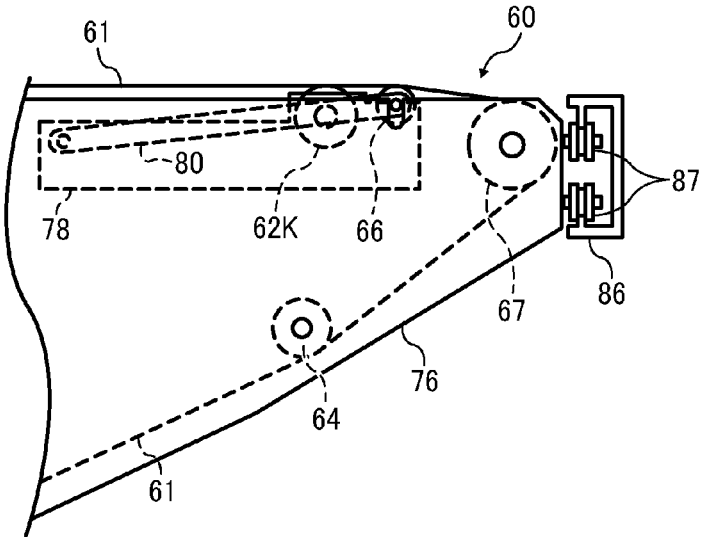
FIG. 6 is an enlarged front elevational view partially illustrating a right half of the transfer unit when the second sub frame unit is moved to a relatively high position.

Referring now to the drawings, wherein like reference numerals designate identical or corresponding parts throughout the several views thereof, and in particular to FIGS. 1, 2, and 6, a typical image processing apparatus 200 of this embodiment is described. As shown in FIG. 1, a printer according to one embodiment of the present invention is described. As shown, the printer includes four image formation units 2*y*, 2*m*, 2*c* and 2*k* forming toner images of these component colors, respectively. A sheet feeding path 30, a previous transfer conveyance path 31, and a manual sheet feeding path 32 are also provided in the printer. Further included are a manual sheet feeding tray 33, a pair of registration rollers 34, and a fixing device 40. Also included are a conveyance direction switching unit 50, a sheet ejection path 51, and a pair of sheet ejection rollers 52. Yet further included are a sheet ejection tray 53, first and second sheet feeding cassettes 101 and 102, and a re-conveyance system or the like. A pair of optical writing units 1YM and 1CK are provided. The image formation units 2*y*, 2*m*, 2*c*, and 2*k* include photoconductive drums 3*y*, 3*m*, 3*c*, and 3*k* as latent image bearers, respectively.

The first and second sheet feeding cassettes 101 and 102 accommodate bundles of recording mediums P, respectively. Multiple sheet feeding rollers 101*a* and 102*a* are driven and rotate thereby launching the top most recording mediums P toward the sheet feeding path 30, respectively. The sheet feeding path 30 connects to a previous transfer conveyance path 34 right before a secondary transfer nip as described later in detail to convey the recording medium P. Accordingly, the recording medium P launched from one of the sheet feeding cassettes 102 and 103 enters the previous transfer conveyance path 34.

The manual sheet feeding tray 33 is openably closably attached to a side surface of the housing of the printer, so that a sheet bundle is set onto the manual sheet feeding tray when it is opened. The top most sheet P of the sheet bundle manually set is launched by a launching roller disposed on the manual sheet feeding tray 3 toward the previous transfer conveyance path 34.

A pair of optical writing units 1YM and 1CK include laser diodes, polygon mirrors, and various lenses, etc., respectively, and drive the laser diodes based on image information read by a scanner externally provided or transmitted from a personal computer, respectively, thereby scanning multiple lights onto the photoconductors 3*y*, 3*m*, 3*c*, and 3*k* of the image formation units 2*y*, 2*m*, 2*c*, and 2*k*, respectively. Specifically, the photoconductors 3*y*, 3*m*, 3*c*, and 3*k* are driven counter clockwise by drivers, not shown, respectively. Further, the optical writing units 1*y* and 1*m* perform optical writing by emitting and deviating the lights in a direction of rotational axes of the photoconductors 3*y* and 3*m* in a driven state thereon, respectively. Hence, latent images are formed on the photoconductors 3*y* and 3*m* in accordance with image information pieces of yellow and magenta component colors, respectively.

A photoconductor as an image bearer and various peripheral devices peripherally disposed therearound are supported by a supporter as a unit in each of the image formation units 2*y*, 2*m*, 2*c*, and 2*k*. Accordingly, such units are detachably attachable from and to a body of the printer. These units have substantially the same configuration except for color of toner. For example, the image formation unit 2*y* for yellow includes the photoconductor 3*y* and a developing device 4*y* that develops a latent image on the photoconductor 3*y* as a yellow color toner image. Further included in the image formation unit 2*y* are a charger 5*y* that uniformly charges the surface of the photoconductor 3*y* in a driven state and a drum cleaner 6*y* that cleans the surface of the photoconductor 3*y* passing through a primary transfer nip for yellow by removing residual toner or the like attracted thereonto.

Further, the four image formation units 2*y*, 2*m*, 2*c*, and 2*k* are arranged along an endless circulation direction of the intermediate transfer belt 61 as described later in detail. Specifically, the printer is a tandem type.

The photoconductor 3*y* is a drum state and is composed of a pipe made of aluminum or the like having a photoconductive layer thereon formed from a coat of organic photoconductive material. However, an endless type photoconductor can be employed.

The developing device 4*y* develops a latent image with two-component developer having magnetic carrier and non-magnetic yellow toner, not shown, (herein after simply referred to as developer). Instead of the two-component developer, one component developer excluding magnetic carrier can be used in a developing system. Yellow color toner is supplied to a yellow toner bottle 4*y* from a yellow toner supplying device, not shown, in the developing device 4*y*.

The drum cleaner 6*y* is a blade type made of polyurethane rubber and is pressed against the photoconductor 3*y*. However, the other type can be employed. In this embodiment, to increase a cleaning ability, a freely rotatable fur brush contacts the photoconductor 3*y*. The fur brush has functions to scrape lubricant in a powder state from solid lubricant agent, not shown, and coats the surface of the photoconductor 3*y* therewith.

A charge removing lamp, not shown, is disposed above the photoconductor 3Y as a part of the image formation unit 2*y*. The charge removing lamp removes charge from the surface of the photoconductor 3Y passing through the drum cleaner 6*y* by emitting light thereonto. The surface of the photoconductor 3*y* subjected to such charger removal is uniformly charged by the charger 5*y*, and then enters a light scanning process of the optical writing unit 1YM. The charger 5*y* is driven and rotates receiving charge bias from a power supply, not shown. Instead of such a charger 8*y*, a scorotron charger system of a non-contact type not contacting the photoconductor 3*y* can be employed.

The remaining image formation units 2*m*, 2*c*, and 2*k* have substantially the same configuration as the image formation unit 2*y* of yellow.

Below the four image formation units 2*y*, 2*m*, 2*c*, and 2*k*, there is provided a belt unit serving as a transfer unit 60. The transfer unit 60 includes an intermediate transfer belt 61 supported by multiple belt support rollers and endlessly circulated by one of the rollers clockwise in the drawing contacting the photoconductors 3*y*, 3*m*, 3*c*, and 3*k*. Hence, multiple primary transfer nips for yellow, magenta, cyan, and black are formed, in which the photoconductors 3*y*, 3*m*, 3*c*, and 3*k* contact the intermediate transfer belt 61.

The primary transfer rollers 62 for yellow, magenta, cyan, and black located in the vicinity of the primary transfer nips for yellow, magenta, cyan, and black press the intermediate transfer belt 66 against the photoconductors 3*y*, 3*m*, 3*c*, and 3*k* receiving primary transfer biases from a power supply, not shown, respectively. Hence, primary transfer electric fields capable of electrostatically moving toner images from the photoconductors 3*y*, 3*m*, 3*c*, and 3*k* onto intermediate transfer belt 61 are generated, respectively.

As the intermediate transfer belt 61 endlessly travels along the yellow, magenta, cyan, and black use primary transfer nips clockwise one after another in the drawing, toner images are superposed at the primary transfer nips on the front surface thereof in each of primary transfer processes. With this superposition in the primary transfer process, a four component color superposed toner image is formed on the front side of the intermediate transfer belt 61.

Further, there is provided a secondary transfer roller 72 below the intermediate transfer belt 61 in the drawing. The secondary transfer roller 72 contacts a prescribed section of the intermediate transfer belt 61 from a front surface side thereof being opposed to a secondary transfer backup roller 68, thereby forming a secondary transfer nip therewith.

A secondary transfer bias is applied to the second transfer roller 72 from a power supply, not shown. Whereas, the secondary transfer backup roller 68 disposed within the belt loop is grounded. Hence, a secondary transfer electric field is generated in the secondary transfer nip.

On the right side of the secondary transfer nip in the drawing, there is provided the above-described pair of registration rollers 34 to pinch and feed a recording medium P at a prescribed time synchronizing with the superposed four color toner images coming to the secondary transfer nip. In the secondary transfer nip, the four color toner images on the intermediate transfer belt 61 are transferred at once on a white recording medium in a secondary transfer electric field receiving a nip pressure as a secondary transfer process, thereby forming a full-color image thereon.

On the front surface of the intermediate transfer belt 61 passing through the secondary transfer nip, post transfer residual toner not transferred onto the recording medium P during the secondary transfer process remains. However, such residual transfer toner may be removed by the cleaner 75 contacting the intermediate transfer belt 61.

The recording medium P passing through the secondary transfer nip separates from the intermediate transfer belt 61 and is conveyed to a conveyance belt unit 35. The conveyance belt 36 is stretched by driving and driven rollers 37 and 38 and is endlessly circulated by the driving roller 37 counter clockwise in the conveyance belt unit 35. Subsequently, the recording medium P conveyed from the secondary transfer nip is further conveyed to the fixing device as the conveyance belt 36 endlessly travels holding the recording medium P on its upper stretching surface.

The fixing device 40 includes a fixing roller 41 having a heat source, such as a halogen lamp, etc., a fixing belt 42, an elastic driving roller 43, and a heating roller 44 having a heat source, such as halogen, etc. The endless fixing belt 42 is stretched by the elastic driving roller 43 and the heating roller 44, and is endlessly circulated clockwise in the drawing as the elastic driving roller 43 rotates clockwise therein. The endless fixing belt 42 is heated by the heating roller 44 at a section opposed to the heating roller 44. The heat source of the heating roller 44 is turned on and off by a fixing temperature controller, not shown. Specifically, the fixing temperature controller turns on and off the above-described power supply so that detection result of a temperature sensor that detects a degree of temperature of the fixing belt 42 can be a prescribed level.

At a section of the endlessly moving fixing belt 42 opposed to the elastic driving roller 43, the fixing roller 41 is driven and rotates counter clockwise contacting the section thereof while forming a fixing nip therewith. The fixing temperature controller also controls tuning on and off of the heat source of the fixing roller 41 to maintain detection result of a temperature sensor, not shown, which detects a degree of temperature of the surface of the fixing roller 41, to be a prescribed level.

The recording medium P passing through the secondary transfer nip is conveyed to the fixing device 40 and is pinched by the fixing nip, so that a toner image thereon is fixed thereto by pressure and heat.

The recording medium P with the fixed toner image on its first surface is launched off toward a conveyance direction switching unit 50.

In this printer, a re-conveyance system is provided formed from the conveyance direction switching unit 50, a re-conveyance path 54, a switchback path 55, and a post switchback path 56 or the like. Specifically, the conveyance direction switching unit 50 switches a direction of conveyance (i.e., a conveyance destination) of the recording medium P upon receiving it from the fixing device 40. More specifically, the conveyance direction switching unit 50 designates a sheet ejection path 51 as the conveyance destination when a printing job is executed in a simplex mode forming an image only on one side of the recording medium P. Thus, the recording medium P with the image only on its one side is conveyed to the pair of sheet ejection rollers 52 via the sheet ejection path 51, and is ejected onto the sheet ejection tray 53 disposed outside. The conveyance direction switching unit 50 also designates the sheet ejection path 51 as the conveyance destination when a printing job is executed in a duplex mode forming images on both sides, respectively, and receives the recording medium P with the images on its both sides from the fixing device 40. Hence, the recording medium P with the images on its both sides is ejected onto the sheet ejection tray 53. By contrast, the conveyance direction switching unit 50 designates the re-conveyance path 54 as the conveyance destination when a printing job is executed in the duplex mode and receives the recording medium P with the image only on its one side from the fixing device 40.

The switchback path 55 connects to the re-conveyance path 54, so that the recording medium P conveyed to the re-conveyance path 54 enters the switchback path 55. When the recording medium P completely enters the switchback path 55, a conveyance direction of the recording medium P is reversed and switchbacks to an opposite direction thereto. Since the switchback path 55 also connects to the post switchback conveyance path 56 beside the re-conveyance path 54, the recording medium P enters thereto and is reversed up side down. The recording medium P being up side down is then conveyed again to the secondary transfer nip via the post switchback conveyance path 56 and the sheet feeding path 30 as well. The recording medium P with the toner image on its second side surface in addition to the first side surface at the secondary transfer nip is conveyed and is fixed in the fixing device 40. The recording medium P is then ejected onto the sheet ejection tray 53 via the sheet ejection path 51 and the pair of sheet ejection rollers 52 as well.

The transfer unit 60 includes multiple belt supporters collectively supporting the intermediate transfer belt 31. The multiple belt supporters are composed of four primary transfer rollers 24*y*, 24*m*, 24*c*, and 24*k* for yellow, magenta, cyan, and black color uses, a driven roller 63, and a steering roller 24. Also first and second assistant rollers 65 and 66, a driving roller 67, a secondary transfer backup roller 68, and first and second cleaning backup rollers 69 and 70 collectively compose the multiple belt supporters.

By rotating it clockwise in the drawing when driven by a driving device, the driving roller 67 circulates the endless intermediate transfer belt 61 clockwise. Further, the driven roller 63 is driven and rotates together with the intermediate transfer belt 61 as it endlessly moves. Further, the first and second cleaning backup rollers 69 and 70 sandwich the intermediate transfer belt 61 with the cleaning brushes or blades of the belt cleaner 75 to backup thereof. Further, a steering roller 64 and first and second assistant rollers 65 and 66 are provided and their functions are described later in detail.

Above the belt cleaner 75, there is provided tension roller 71 to provide tension by applying a bias from an outside of a belt loop toward a front surface of the intermediate transfer belt 61.

Now, the transfer unit 60 is more specifically described with reference to FIG. 2 or the like, wherein a lateral direction of the intermediate transfer belt 61 provided in the transfer unit 60 corresponds to a longitudinal direction of a copier. As shown, rotational axes of various rollers arranged in the transfer unit 60 are arranged in the belt lateral direction (i.e., the longitudinal direction of a copier). These rollers are supported by a front side plate 76 and a rear side plate 76', hidden from view by the front side plate 76 and is therefore not shown in FIG. 2, in the transfer unit 60. A belt opening is formed in one lateral side of the intermediate transfer belt 61 and is covered by the front side plate 76. Further, a belt opening is formed on another lateral end of the intermediate transfer belt 61 and is similarly covered by the rear side plate 76. The front and rear side plates 76 and 76' also support the belt cleaner or the like beside the above-described various rollers.

To left and right ends of a unit frame of the transfer unit 60, pulleys 87 are freely rotatably attached engaging rails secured to the printer housing. These rails extend in the longitudinal direction (i.e., perpendicular to a plane of the drawing) to guide the transfer unit 60 along thereof. Thus, the rail 86 and the pulley 87 collectively constitute a slider supporter that slidably supports the transfer unit 60.

Among the plural support rollers arranged within the loop of the intermediate transfer belt 61, the first assistant roller 65 and yellow and cyan use primary rollers 62*y* and 62*c* are held on a first sub frame unit 77 supported by the front and rear side plates 76 and 76'. Further, the second assistant roller 66 and black use primary roller 62*k* are held on a second sub frame unit 78 supported by the front and rear side plates 76 and 76'. The first and second sub frame units 77 and 78 are independently pulled up and down by elevating mechanisms, not shown, respectively.

Figure 3:
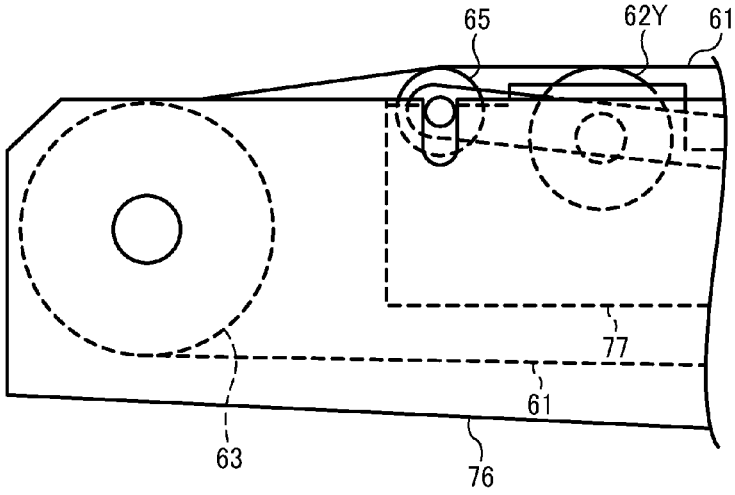
FIG. 3 is an enlarged front elevational view partially illustrating the transfer unit when a first sub frame unit is moved to a relatively high position.
Figure 4:
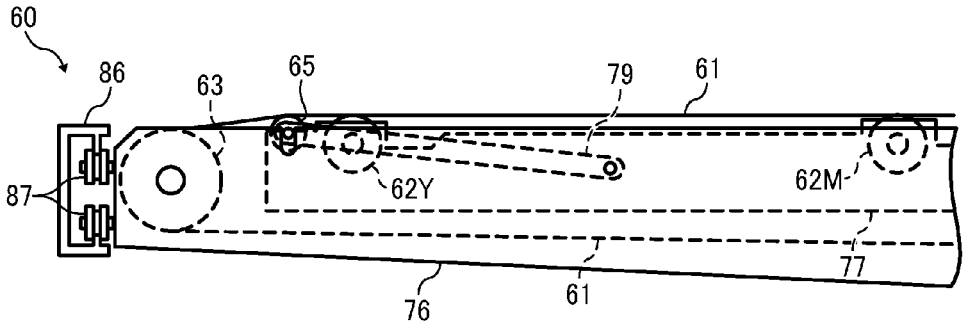
FIG. 4 is an enlarged front elevational view partially illustrating a left half of the transfer unit when the first sub frame unit is moved to a relatively high position.

As shown, the intermediate transfer belt 61 in the transfer unit 60 has a posture enabling endless movement for full-color printing. In such a posture for full-color printing, the first sub frame unit 77 is lifted to a relatively high position by the elevating mechanism so that upper ends of the first assistant roller 65 and the primary transfer roller 62*y* are positioned at a relatively high position as shown in FIG. 3. At that moment, an upper end of the magenta use primary transfer roller 62*m* held by the first sub frame unit 77 is also positioned higher than those of the front and rear side plates 76 and 76' as the yellow use primary transfer roller 62*y* as shown in FIG. 4. Further, an upper end of the cyan use primary transfer roller 62*c* here (see FIG. 2), not shown here, is also positioned higher than those of the front and rear side plates 76 and 76'. Hence, the primary transfer rollers 62*y* to 62*c* sandwich the intermediate transfer belt 61 with the photoconductors 3*y*, 3*m*, and 3*c* and form primary transfer nips for yellow, magenta, and cyan color uses, respectively, as shown in FIG. 1.

Further, as shown in FIG. 4, in the vicinity of the magenta use primary transfer roller 62M, the intermediate transfer belt 61 is stretched and extended substantially horizontally. Also, in the vicinity of the yellow primary transfer roller 62*y*, the intermediate transfer belt 61 is stretched and extended substantially horizontally. Thus, the intermediate transfer belt 61 substantially equally operates at these two primary transfer nips.

Further, as shown in the same drawing, an upper end of the yellow primary transfer roller 62*y* is positioned higher than that of the driven roller 63, while the first assistant roller 65 is positioned at substantially the same height as the primary transfer roller 62*y* between the yellow primary transfer roller 62*y* and the driven roller 63. Thus, if the first assistant roller 65 does not exist, the intermediate transfer belt 61 is stretched being gradually declining obliquely from the yellow primary transfer roller 62*y* toward the driven roller 63 therebetween. In such an oblique posture, a belt winding angle made by the yellow primary transfer roller 62*y* increases greater than that when the belt has a posture being extended horizontally. Consequently, since the intermediate transfer belt 61 operates differently in the yellow primary transfer nip from when operating in the magenta primary transfer nip, a transfer condition becomes different between these two primary transfer nips. Then, in this printer, the first assistant roller 65 is positioned at substantially the same height as the primary transfer roller 62*y* between the yellow primary transfer roller 62*y* and the driven roller 63 as described above. Hence, since the intermediate transfer belt 61 is stretched and extended substantially horizontally in the vicinity of the yellow primary transfer roller 62*y*, substantially the same belt operation can be obtained in the magenta and cyan primary transfer nips (partially one not shown).

Figure 5:
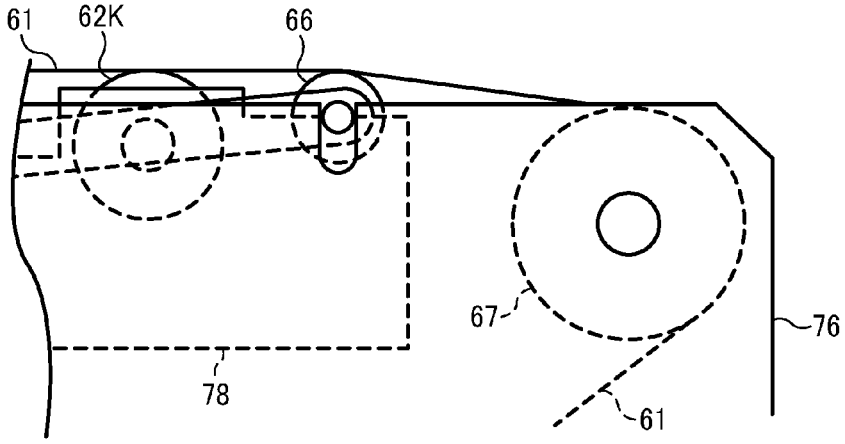
FIG. 5 is an enlarged front elevational view partially illustrating the transfer unit when a second sub frame unit is moved to a relatively high position.

Further, in the posture for the full-color printing, a second sub frame unit 78 is also lifted to a relatively high position by an elevating mechanism so that upper ends of the black primary transfer roller 62*k* and the second assistant roller 66 are positioned higher than upper ends of the front and rear side plates 76 and 76, respectively, as shown in FIGS. 5 and 6. Hence, the black primary transfer roller 62K sandwiches the intermediate transfer belt 61 thereby forming a primary transfer nip for black together with the photoconductor 3K as shown in FIG. 1. Further, a second assistant roller 66 also functions to equalize belt operation in the black primary transfer nip with those of yellow to cyan primary transfer nips in FIG. 6.

Hence, with the full-color printing use posture, the intermediate transfer belt 61 is endlessly circulated contacting the four photoconductors while forming primary transfer nips for yellow, magenta, cyan, and black component therebetween.

Figure 7:
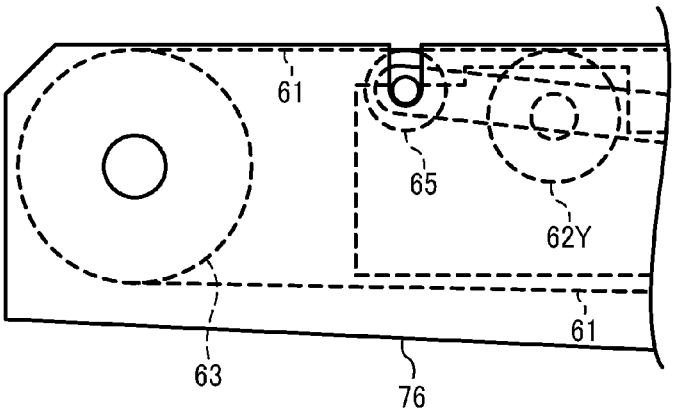
FIG. 7 is an enlarged front elevational view partially illustrating the transfer unit when the first sub frame unit is moved to a relatively low position.
Figure 8:
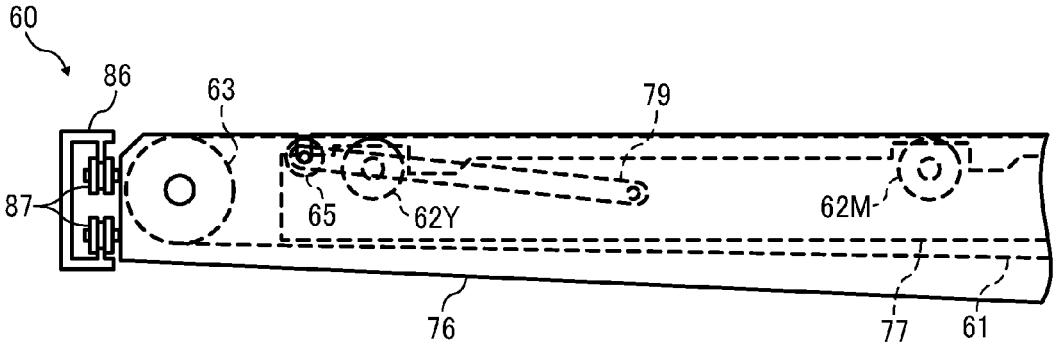
FIG. 8 is an enlarged front elevational view partially illustrating a left half of the transfer unit when the first sub frame unit is moved to a relatively low position.

The transfer unit 60 can cause the intermediate transfer belt 61 to have a posture for monochrome printing use as an use state beside the above-described full-color printing use posture. Specifically, the first sub frame unit 77 is lowered down to a relatively low position by the elevating mechanism so that upper ends of the yellow primary transfer roller 62*y* and the first assistant roller 65 are positioned lower than those of the front and rear side plates 76 and 76, respectively, as shown in FIG. 7. At that moment, upper ends of the magenta and cyan primary transfer rollers 62*m* and 62*c* (not shown) are positioned lower than those of the front and rear side plates 76 and 76 as shown in FIG. 8. Hence, the primary transfer rollers 62*y* to 62*c* separate from the photoconductor for yellow to cyan of FIG. 1. On the other hand, since the second sub frame unit 78 keeps the high level as shown in FIG. 6, the intermediate transfer belt 61 continuously engages the photoconductor for black color use. Hence, in the monochrome printing use posture, the intermediate transfer belt 61 endlessly moves only contacting the black photoconductor to form a monochrome image.

Figure 9:
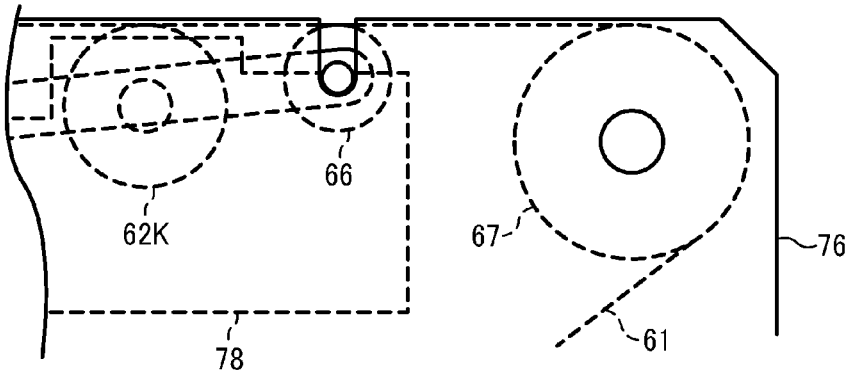
FIG. 9 is an enlarged front elevational view partially illustrating the transfer unit when the second sub frame unit is moved to a relatively low position.
Figure 10:
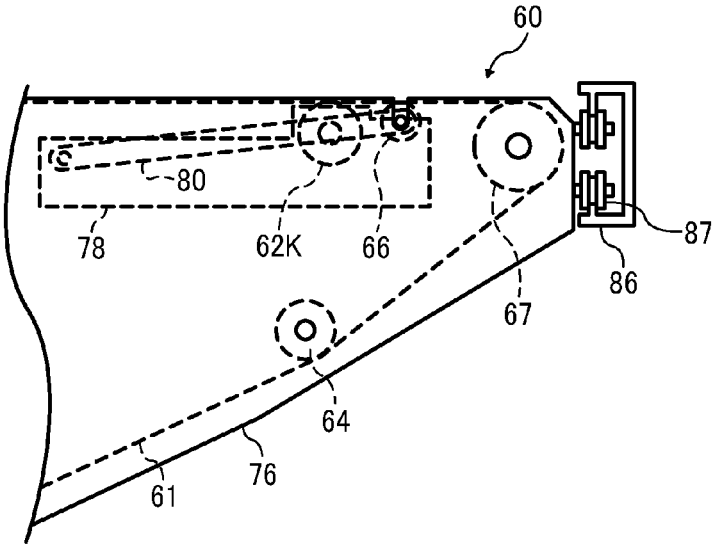
FIG. 10 is an enlarged front elevational view partially illustrating a right half of the transfer unit when the second sub frame unit is moved to a relatively low position.
Figure 11:
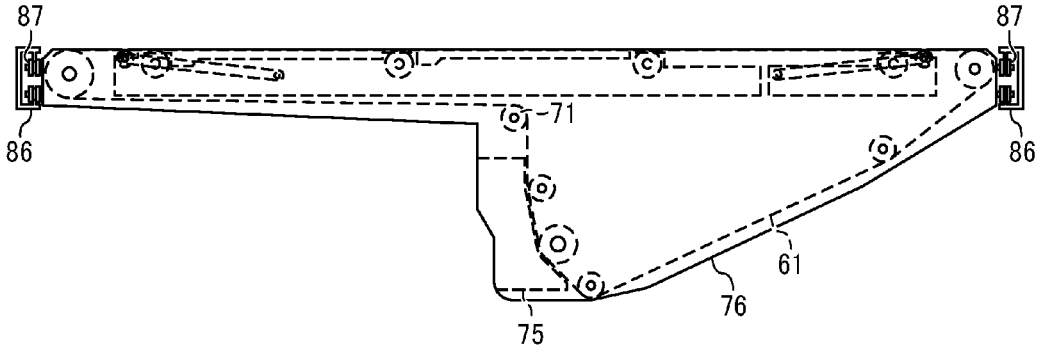
FIG. 11 is a front elevational view illustrating the transfer unit when an intermediate transfer belt has a unit pull out use posture.

Further, the transfer unit 60 can cause the intermediate transfer belt 61 to have a unit pull out state for pulling a unit out beside those for the full-color and monochrome printings. In such a unit detachment state, similar to the monochrome printing use posture, the first sub frame unit 77 is moved to a relatively low position by the elevating mechanism. Further, the second sub frame unit 78 is also moved to a relatively low position by the elevating mechanism, not shown, as shown in FIGS. 9 and 10. As a result, upper ends of the black primary transfer roller 62*k* and the second assistant roller 66 are positioned lower than those of the front and rear side plates 76 and 76'. Subsequently, a level of upper stretching surface of the intermediate transfer belt 61 is lowered than the upper ends of the front and rear side plates 76 and 76' as shown in FIG. 11, so that the intermediate transfer belt 61 is completely separated from the photoconductors of yellow, magenta, cyan, and black color uses.

Further, an openable and closable door cover is disposed on the front side plate, not shown, of the housing of the printer. Therefore, an operator can expose the front side of the transfer unit 60 currently installed in the printer housing by opening the door cover. Subsequently, by drawing the transfer unit 60 having the unit detachment state to the front side of FIG. 11, the operator can execute various maintenance operations of the transfer unit 60.

In the above-described transfer unit 60, a combination of the front and rear side plates 76 and 76', the first and second sub frame units 77 and 78, and later described first and second arms 79 and 80 or the like collectively serve as the holder that holds various belt support rollers.

Now, a distinguishing feature of a printer according to one embodiment of the present invention is described. As shown in FIG. 11, a belt opening formed on the front side of the intermediate transfer belt 61 in the drawing is covered by the front side plate 76, while that of the rear side by the rear side plate, respectively. Thus, it is difficult for an operator to access an interior of the loop of the intermediate transfer belt 61. However, he or she can relatively readily access parts disposed in an outside of the loop of the intermediate transfer belt 61. For example, the belt cleaner 75 and the tension roller 71 are supported by the front and rear side plates 76 on the outside of the belt loop and are readily accessed. Because, nothing covers a left side surface of the belt cleaner or that of the tension roller 71 in the drawing.

Figure 12:
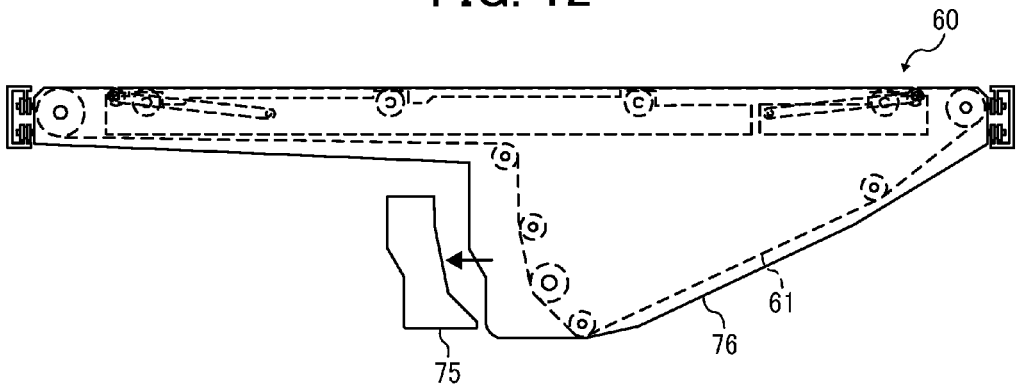
FIG. 12 is a front elevational view illustrating the transfer unit when the intermediate transfer belt has the detachment state and a cleaning device is detached therefrom.
Figure 13:
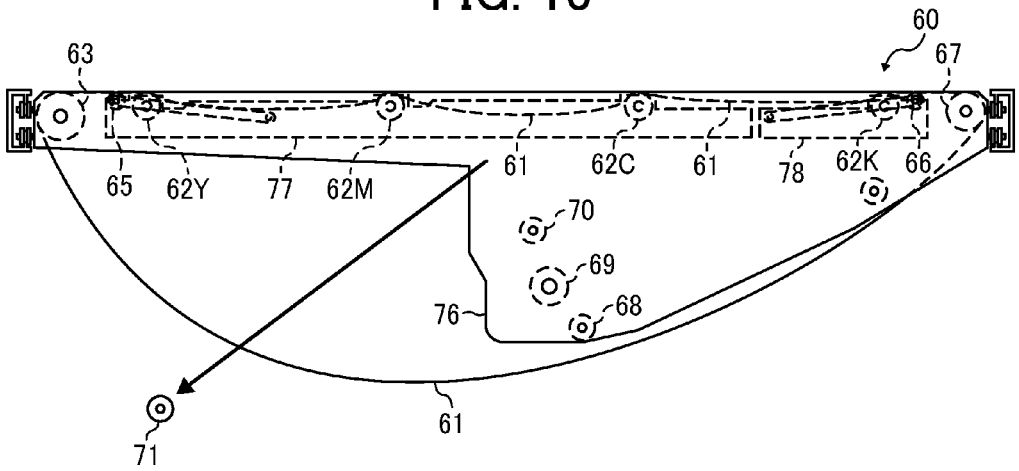
FIG. 13 is a front elevational view illustrating the transfer unit when an intermediate transfer belt has tension reduced posture.
Figure 14:
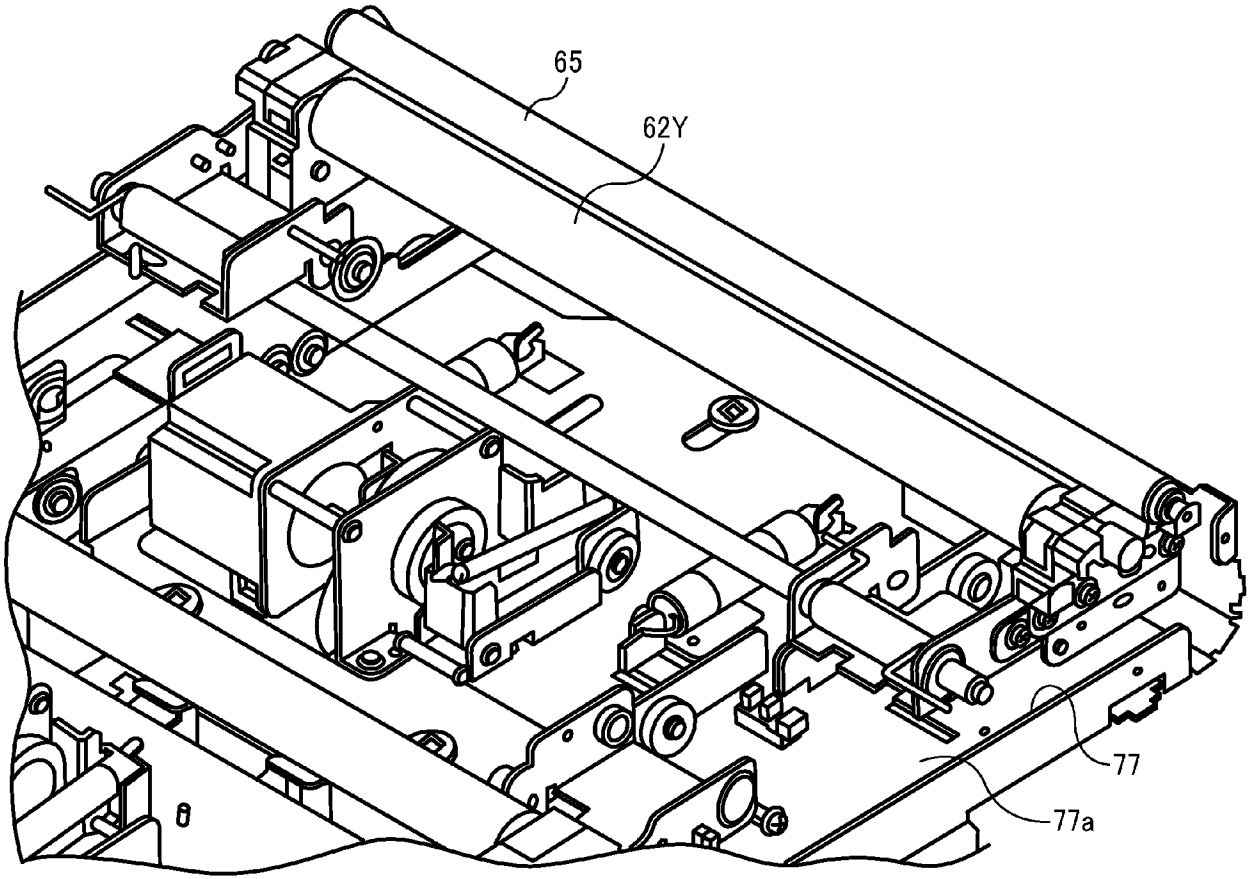
FIG. 14 is a perspective view partially illustrating the first sub frame unit of the transfer unit.

Whereas, when executing a maintenance of parts arranged within the loop of the transfer unit 60 after detachment thereof from the printer housing, the operator detaches the belt cleaner 75 from the front and rear side plates 76 and 76' of the transfer unit 60 as shown in FIG. 12. Subsequently, he or she detaches the tension roller 71 from the front and rear side plates 76 and 76' of the transfer unit 60 as shown in FIG. 13. Consequently, tension of the intermediate transfer belt 61 is largely reduced and a lower stretching section of the intermediate transfer belt 61 pushed up within the belt loop until then largely dips downward. Hence, the belt opening is not completely covered by the front and rear side plates 76 and 76' and is partially exposed to an outside (hereinafter simply referred to as tension reduced posture). Accordingly, the operator can access four parts of a second transfer backup roller 68, first and second cleaner backup rollers 69 and 70, and a driven roller 63 among various parts arranged within the belt loop via the belt opening exposed to the outside in the tension reduced posture. However, even in that situation, the primary transfer rollers 62*y*, 62*m*, 62*c*, and 62*k* for yellow, magenta, cyan, and black and the first and second assistant rollers 65 and 66 or the like are extraordinarily hardly accessed. That is, to access the above-described rollers, hand inserted into the frame from below the first and second sub frame units 77 and 78 needs to further reach an upper section thereof. However, since a beam 77*a* is disposed at a lower section in the sub frame unit as shown in FIG. 14, the hand cannot enter the frame from below.

Then, the operator changes a state of the intermediate transfer belt 61 to have an interior parts detachment and attachment state to upgrade accessibility of the primary transfer rollers 62*y*, 62*m*, 62*c*, and 62*k*. For example, when yellow primary transfer roller 62*y* is maintained, the operator changes the state from the tension reduced posture to a first detachment and attachment state as an interior parts detachment and attachment state as described later in detail.

Figure 15:
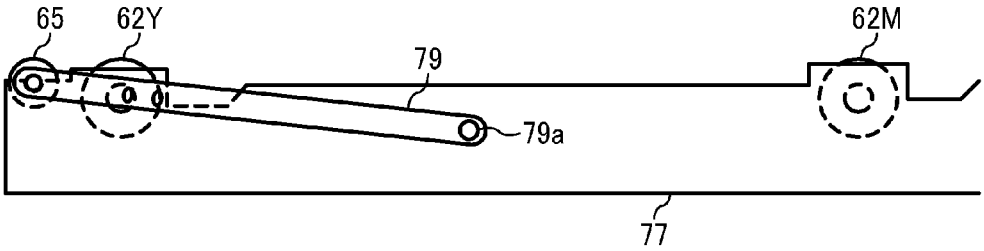
FIG. 15 is a front elevational view partially illustrating the first sub frame unit of the transfer unit.
Figure 16:
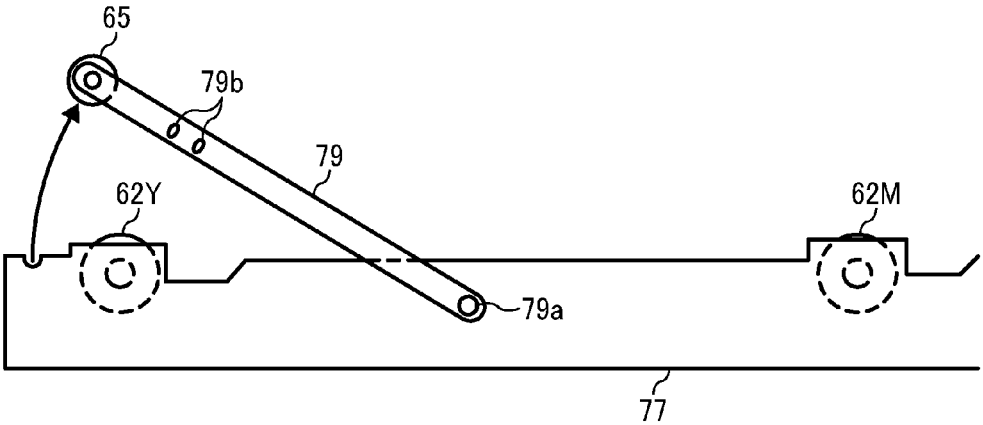
FIG. 16 is a front elevational view partially illustrating the first sub frame unit of the transfer unit when a first arm is latched at a different swinging position from that in FIG. 15.
Figure 17:
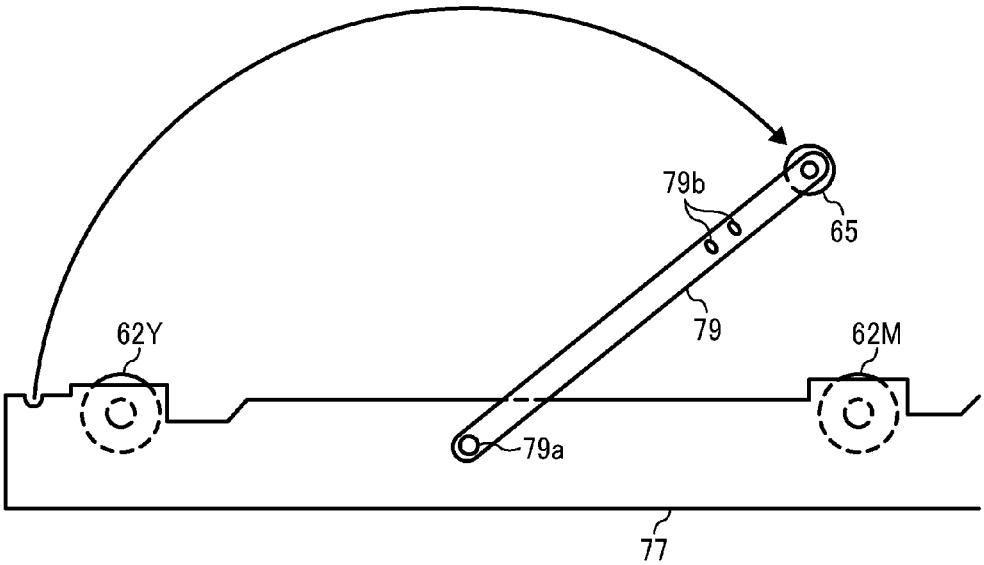
FIG. 17 is a front elevational view partially illustrating the first sub frame unit of the transfer unit when the first arm is latched at another different swinging position from those in FIGS. 15 and 16.

For that reason, a first sub frame unit 77 included in the transfer unit 60 is operated as described below with reference to FIG. 15. As shown, the first assistant roller 65 serves as a transfer roller adjacent member arranged adjacent to the yellow or magenta primary transfer roller 62*y* or 62*m*, and is freely rotatably supported by the first arm 79. A swinging shaft 79*a* penetrates one end of the first arm 79 and is secured to the first sub frame unit 77. An opposite end to one end of the first arm 79 freely rotatably supports the first assistant roller 65. Hence, when the intermediate transfer belt 61 has the tension reduced posture and a shaft of the first assistant roller 65 hooks into a cut away section formed on an upper end of the first sub frame unit 77 due to its own gravity, the first arm 79 stops swinging as shown in the drawing. In this situation, the operator pinches and lifts a shaft of the first assistant roller 65 protruding to the front side from the front side plate 76, and swing the first arm 79 as shown in FIGS. 16 and 17. Hence, the first assistant roller 65 moves from the inside toward the outside of the belt loop independently of the respective primary transfer rollers 62*y*, 62*m*, 62*c*, and 62*k*. Since multiple positioning holes 79*b* are formed on the first arm 79 to engage positioning use jigs, not shown, the operator can stop its swinging around the swinging shaft 79*a* of the first arm 79 at a prescribed position by securing the first arm to the first sub frame unit 77 with a positioning use jig fitting into the positioning hole 79*b*.

Figure 18:
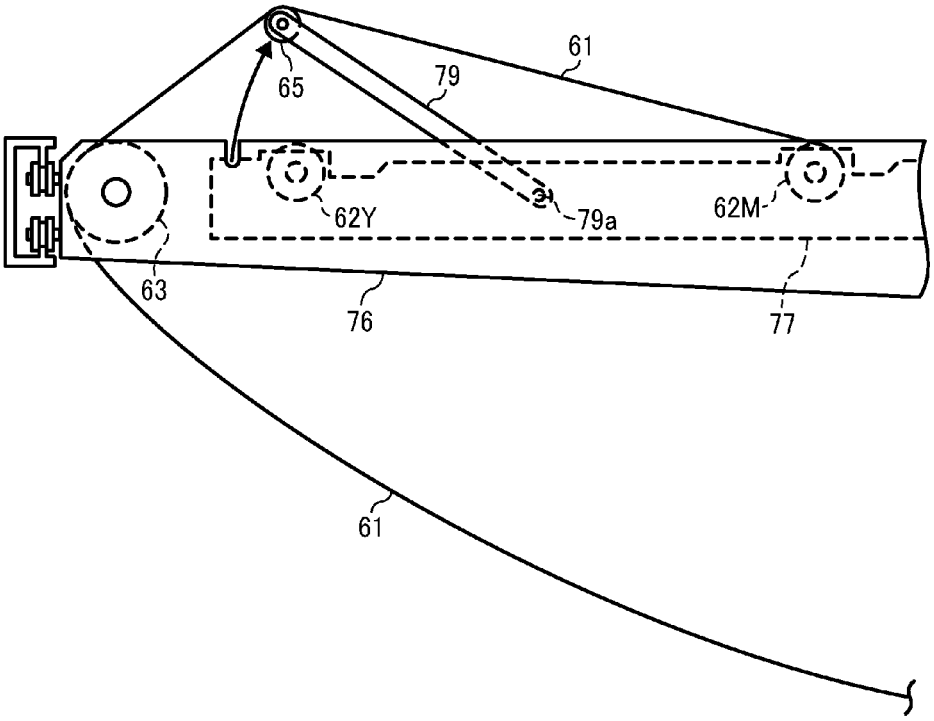
FIG. 18 is an enlarged front elevational view partially illustrating the transfer unit when the intermediate transfer belt has a first detachment and attachment use posture.
Figure 19:
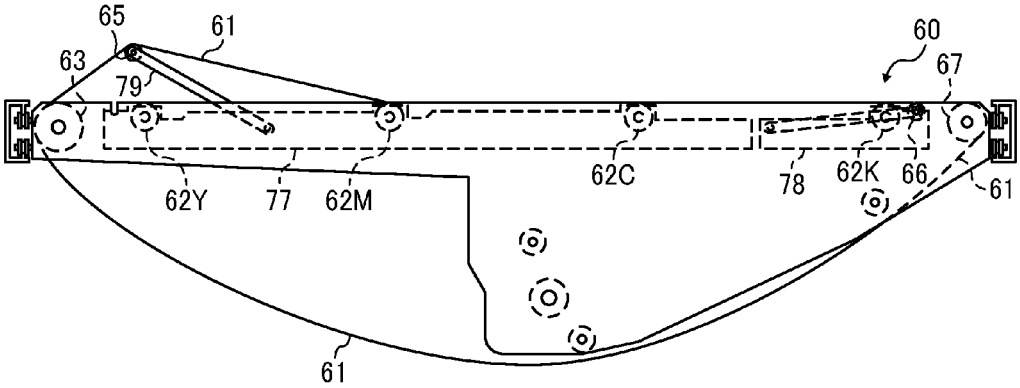
FIG. 19 is a front elevational view illustrating the transfer unit when the intermediate transfer belt has the first detachment and attachment use posture.

Specifically, when the state is changed from the above-described tension reduced posture to the first detachment and attachment state (i.e., an inner parts detachment and attachment state), the operator stops the first arm 79 swinging around the swinging shaft 79*a* when the first assistant roller 65 comes to a position right above the yellow primary transfer roller 62 as shown in FIG. 16. Consequently, a section of the belt positioning in the vicinity of the first assistant roller 65 is lifted by the first assistant roller 65 to a higher position than the upper ends of the front and rear side plates 76 and 76' as shown in FIGS. 18 and 19. Hence, the belt opening is lifted not to be hidden by the front and rear side plates 76 and 76' in the vicinity of the yellow primary transfer roller 62*y*, so that the yellow primary transfer roller 62*y* can be readily accessed. Accordingly, when the intermediate transfer belt 61 has the first detachment and attachment state, detachment and attachment performance of the first assistant roller 65 and the primary transfer roller 62*y* can be upgraded.

Figure 20:
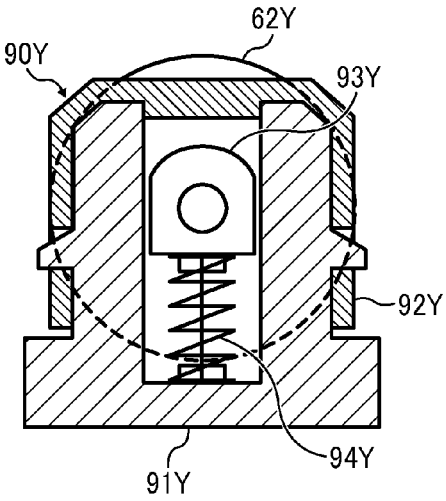
FIG. 20 is a cross-sectional view illustrating a yellow primary transfer roller holder and a yellow primary transfer roller freely rotatavely supported by the yellow primary transfer roller holder.

Further, as shown FIG. 20, a yellow primary transfer roller holder 90*y* freely rotatably supporting a yellow primary transfer roller 62*y* is provided. Specifically, the yellow primary transfer roller 62*y* is supported by the first sub frame unit 77 via the primary transfer roller holder 90*y*. The primary transfer roller holder 90*y* includes a holder body 91*y*, a cap 92*y*, a roller bearing 93*y*, and a bias coil spring 94*y*. The holder body 91*y* includes a cutaway downwardly extended from an upper end in a vertical direction. The roller bearing 94*y* is vertically slidably held within the cutaway receiving the shaft of the yellow primary transfer roller 62*y*. The cap 92*y* is detachably attached to an upper end of the holder body 91*y* to shield the cutaway of the holder body 91*y*. The roller bearing 94*y* is biased toward the cap 92*y* by a bias coil spring 94*y* secured to a bottom wall of the cutaway. Hence, the yellow primary transfer roller 62*y* freely rotatably supported by the roller bearing 94*y* is biased toward a yellow photoconductor, not shown here. When the first frame 77, not shown, is moved to a relatively high position as shown in FIG. 4 to make the intermediate transfer belt 61 to have the full-color printing state, the primary transfer roller 62*y* supported by the roller bearing 94*y* contacts the yellow photoconductor, not shown, via the intermediate transfer belt, not shown, before the roller bearing 93*y* biased toward the cap 92*y* by the bias coil spring 94*y* contacts the cap 92*y* as shown in FIG. 20. Thus, the roller bearing 93*y* is positioned lower than a contact position to contact the cap 92*y*.

Figure 21:
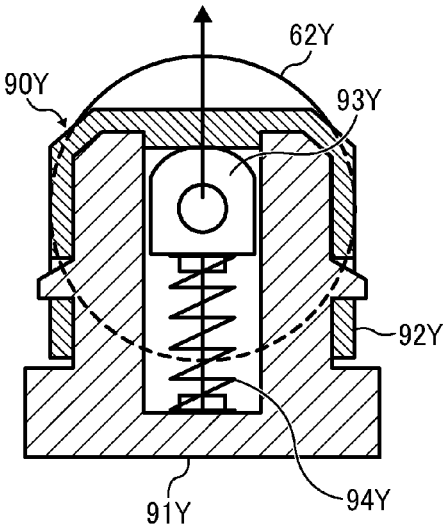
FIG. 21 is a cross-sectional view illustrating the yellow primary transfer roller holder and the yellow primary transfer roller freely rotatavely supported by the yellow primary transfer roller holder when a slipping roller bearing is moved and engages a cap.

When the first sub frame unit 77 is moved to a relatively low position as shown in FIG. 8, the yellow primary transfer roller 62*y* does not contact the yellow photoconductor via the intermediate transfer belt. As a result, the roller bearing 93*y* biased by the bias coil spring 64*y* is moved to contact the cap 92*y* as shown in FIG. 21. Specifically, when the intermediate transfer belt has the above-described detachment state and the transfer unit 60 is pulled out from the printer housing, the roller bearing 93*y* is moved to a position to contact the cap 92*y* as shown.

Figure 22:
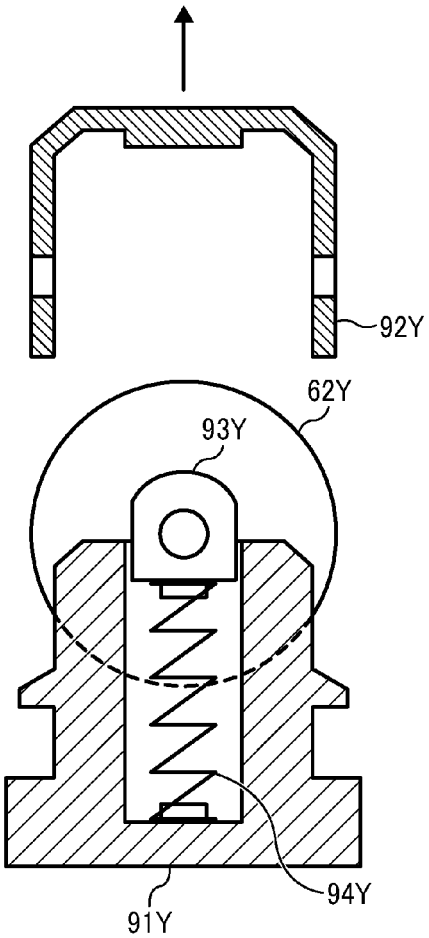
FIG. 22 is a cross-sectional view illustrating the yellow primary transfer roller holder and the yellow primary transfer roller freely rotatavely supported by the yellow primary transfer roller holder when the cap is removed.
Figure 23:
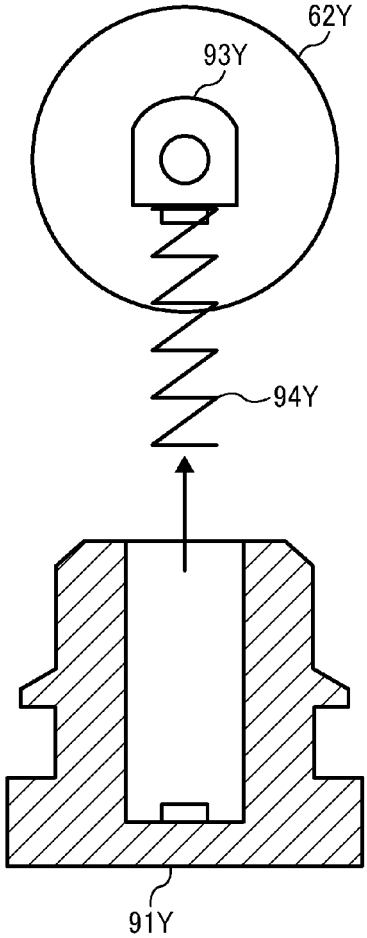
FIG. 23 is a cross-sectional view illustrating the yellow primary transfer roller holder and the yellow primary transfer roller freely rotatavely supported by the yellow primary transfer roller holder when the slip roller bearing is detached form a body of the holder.

Further, when the intermediate transfer belt 61 of the transfer unit 60 now detached from the printer housing has the first detachment and attachment state as shown in FIG. 19, the yellow primary transfer roller holder 90*y* of FIG. 21 can be readily accessed. In this situation, the operator detaches the cap 92*y* from the holder body 91*y*, and exposes the roller bearing 93*y* to an outside thereof in the hold body 91*y* as shown in FIG. 22. Then, the operator pull outs the roller bearing 93*y* from the holder body 91*y*. Hence, the primary transfer roller 62*y* can be detached from the roller bearing 93*y* to either maintain or replace the primary transfer roller 62*y*. The remaining color component primary transfer rollers 62*m*, 62*c*, and 62*k* are similarly rotatably supported by primary transfer roller holders, respectively.

Further, when maintaining the first assistant roller 65 and the magenta primary transfer roller 62*m*, the operator changes the state from the tension reduced posture to a second detachment and attachment state (i.e., another inner parts detachment and attachment state) described later in detail.

Figure 24:
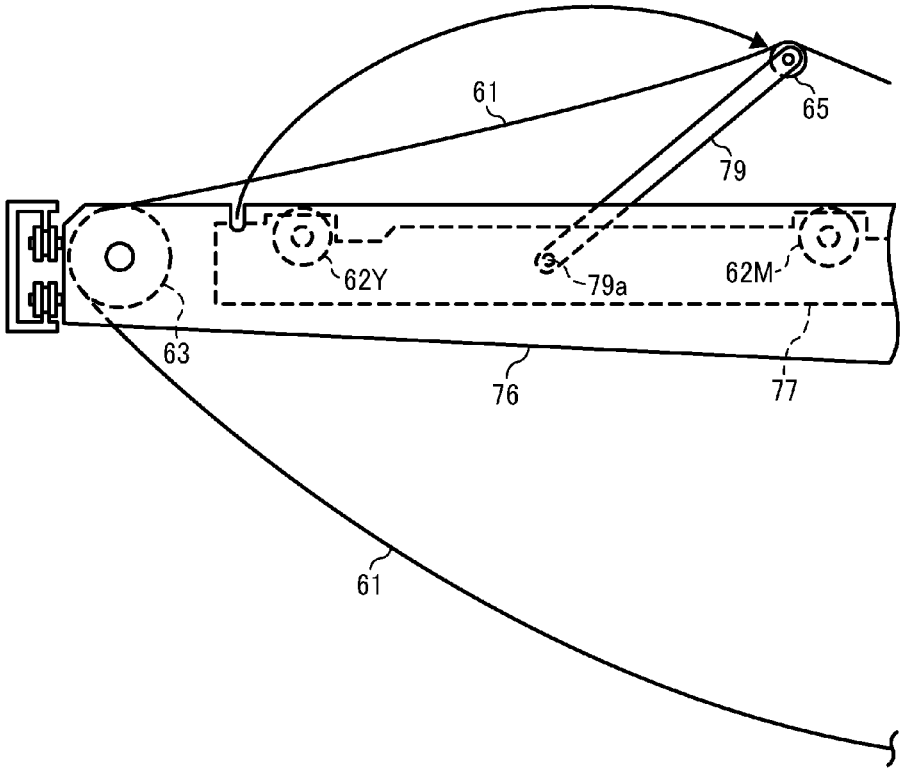
FIG. 24 is an enlarged front elevational view partially illustrating the transfer unit when the intermediate transfer belt has a second detachment and attachment use posture.
Figure 25:
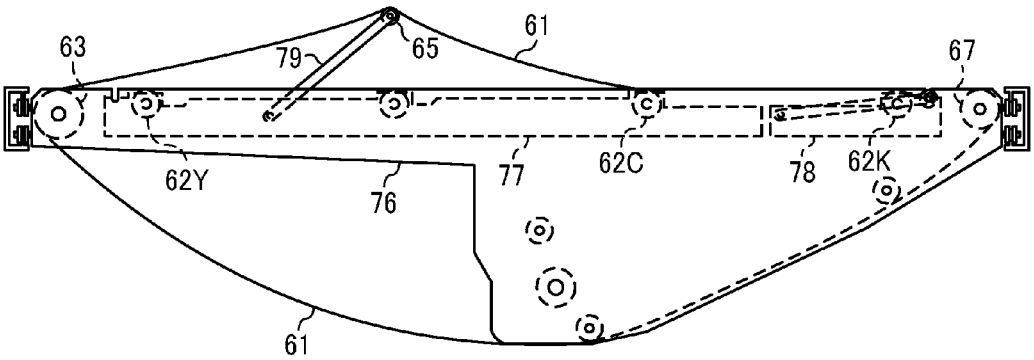
FIG. 25 is a front elevational view illustrating the transfer unit when the intermediate transfer belt has the second detachment and attachment use posture.

Now, the second detachment and attachment state is described with reference to FIGS. 24 and 25. As shown, when the intermediate transfer belt 61 has the tension reduced posture, the operator pinches and lifts the shaft of the first assistant roller 65 protruding to the front side from the front side plate 76 and swing the first arm 79 clockwise by a prescribed degree of angle in a direction as shown by an arrow in the drawing. When the first assistant roller 65 is moved to right above the primary transfer roller 62*m*, the operator stops the first arm 79 at a position as shown in the drawing using the jig, not shown. As a result, a section of the belt positioned in the vicinity of the first assistant roller 65 is lifted by the first assistant roller 65 right above the magenta primary transfer roller 62*m* higher than the upper ends of the front and rear side plates 76 and 76'. Hence, by moving the belt opening to a position not hidden by the front and rear side plates 76 and 76' in the vicinity of the magenta primary transfer roller 62*m*, the operator can readily access the primary transfer roller 62*m*. Specifically, the operator can easily visually recognize and grasp the first assistant roller 65 and the magenta primary transfer roller 62*m* as well through the belt opening moved to the position not hidden by the front and rear side plates 76 and 76'. Since detachment and attachment performance of the first assistant roller 65 and the magenta primary transfer roller 62*m* is upgraded by changing the state of the intermediate transfer belt 61 to the second detachment and attachment state in this way, the above-described various rollers can be readily maintained.

Further, when the second assistant roller 66 and the black primary transfer roller 62*k* are maintained, the state is changed from the tension reduced posture to a third detachment and attachment state (i.e., an inner parts detachment and attachment state) as described below in detail.

Figure 26:
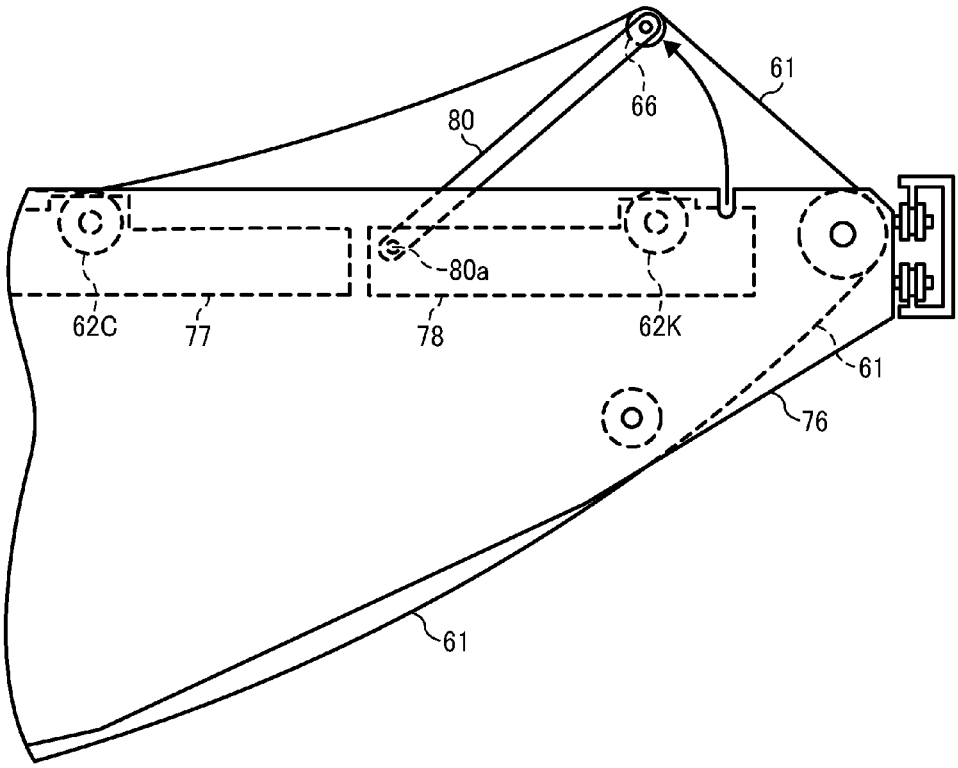
FIG. 26 is an enlarged front elevational view partially illustrating the transfer unit when the intermediate transfer belt has a third detachment and attachment use posture.
Figure 27:
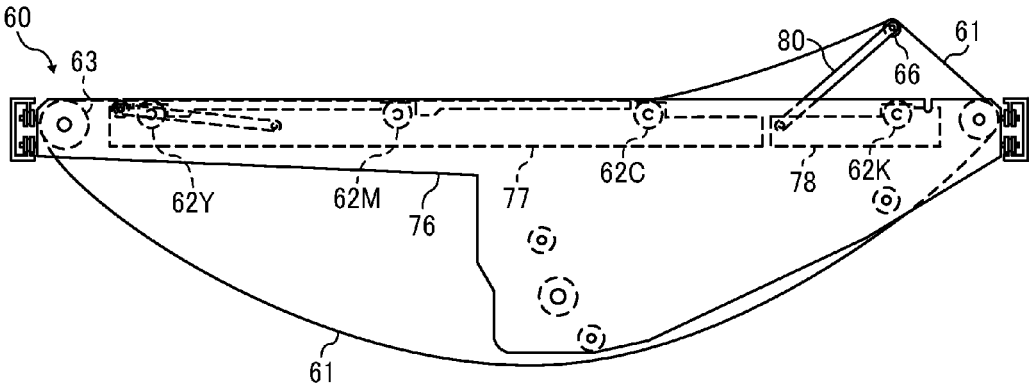
FIG. 27 is a front elevational view illustrating the transfer unit when the intermediate transfer belt has the third detachment and attachment use posture.

Now, the third detachment and attachment state is described in detail with reference to FIGS. 26 and 27, in which a right side end and front side view of the transfer unit 60 are illustrated, respectively. As shown, a second assistant roller 66 is supported by a second arm 80. A swinging shaft 80*a* penetrates one end of the second arm 80 and is secured to the second sub frame unit 78. An opposite end of the second arm 80 freely rotatably supports the second assistant roller 66. Thus, the second arm 80 is swingably supported by a second sub frame unit 78 around the swinging shaft 80*a*. When the intermediate transfer belt 61 has the tension reduced posture, and a shaft of the second assistant roller 66 hooks into a cut away section formed on an upper end of the second sub frame unit 78 due to own gravity, the second arm 80 stops swinging. In this situation, the operator pinches and lifts the shaft of the second assistant roller 66 protruding to the front side from the front side plate 76, and swings the second arm 80 counter clockwise as shown by an arrow in the drawing by a prescribed degree of angle. When the second assistant roller 66 is moved to right above the primary transfer roller 62*k*, the operator stops swinging of the second arm 80 as shown in the drawing using a jig, not shown. As a result, a section of the belt in the vicinity of the second assistant roller 66 is lifted by the second assistant roller 66 higher than the upper ends of the front and rear side plates 76 and 76'. Hence, by moving the belt opening to a position not hidden by the front and rear side plates 76 and 76' in the vicinity of the black primary transfer roller 62*m*, the operator can readily access the primary transfer roller 62*k*. Specifically, the operator can easily visually recognize and grasp the second assistant roller 66 and the black primary transfer roller 62*k* as well through the belt opening moved to the position not hidden by the front and rear side plates 76 and 76'. Hence, since detachment and attachment performance of the second assistant roller 66 and the black primary transfer roller 62*k* is upgraded by changing the state of the intermediate transfer belt 61 to the third detachment and attachment state in this way, these rollers can be readily maintained.

Further, the operator can further change the state of the intermediate transfer belt 61 to a fourth detachment and attachment state to maintain the second assistant roller 66 and the cyan primary transfer roller 62*c*.

Figure 28:
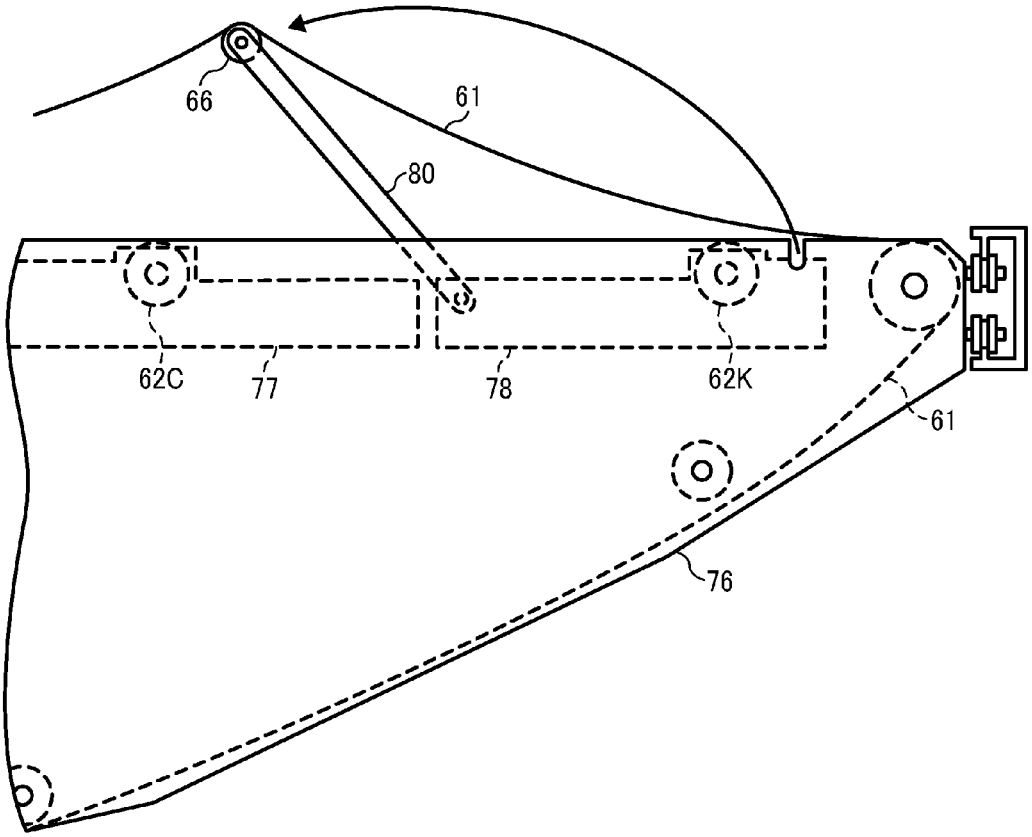
FIG. 28 is a front elevational view illustrating the transfer unit when the intermediate transfer belt has a fourth detachment and attachment use posture.
Figure 29:
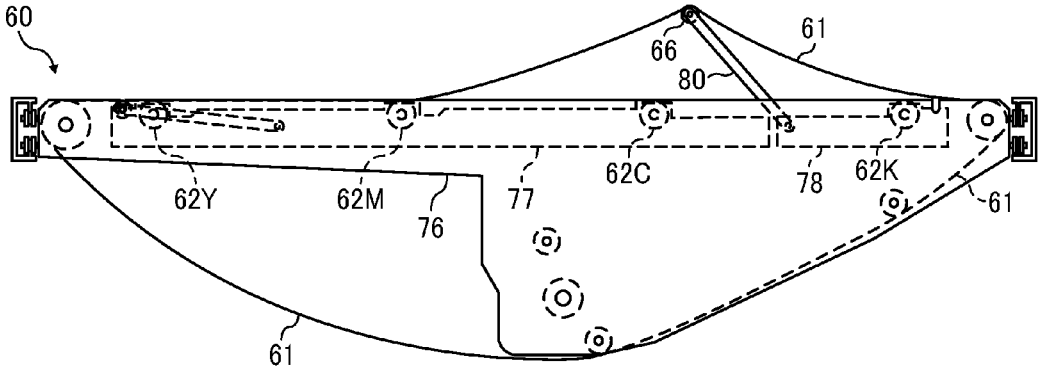
FIG. 29 is a front elevational view illustrating the transfer unit when the intermediate transfer belt has the fourth detachment and attachment use posture.

Now, the fourth detachment and attachment state is described in detail with reference to FIGS. 28 and 29. When the intermediate transfer belt 61 has tension reduced posture, the operator pinches and lifts a shaft of the second assistant roller 66 protruding to the front side therefrom from the front side plate 76 while swinging the second arm 80 counter clockwise as shown by an arrow in the drawing by a prescribed degree of angle. When the second assistant roller 66 is moved to right above the cyan primary transfer roller 62*c*, the operator stops swinging of the second arm 80 at a position as shown in the drawing using a jig, not shown. As a result, a section of the belt in the vicinity of the second assistant roller 66 is lifted right above the cyan primary transfer roller 62*c* by the second assistant roller 66 higher than the upper ends of the front and rear side plates 76 and 76'. Hence, by moving the belt opening to a position not hidden by the front and rear side plates 76 and 76' in the vicinity of the cyan primary transfer roller 62*c*, the operator can readily access the primary transfer roller 62*c*. Specifically, the operator can easily visually recognize and grasp the second assistant roller 66 and the black primary transfer roller 62*k* as well through the belt opening moved to the position not hidden by the front and rear side plates 76 and 76'. Hence, since detachment and attachment performance of the second assistant roller 66 and the cyan primary transfer roller 62*s* is upgraded by changing the state of the intermediate transfer belt 61 to the fourth detachment and attachment state in this way, these rollers can be readily maintained.

Further, the transfer unit 60 sometimes needs some maintenance or replacement of the intermediate transfer belt 61 and the like. Then, the intermediate transfer belt 61 needs to have the tension reduced posture as shown in FIG. 13 and is to be pulled out to the front side in the drawing from the side plate 76 and the frame of the transfer unit 60. However, as shown, the intermediate transfer belt 61 trails down between the driven roller 63 and the driving roller 67 (i.e., a belt stretching region between respective primary transfer rollers) due to its gravity, and positions between the upper end and the lower end of the front side plate 76. As a result, the above-described region hooks into the front side plate 76 when the intermediate transfer belt 61 is pulled out. Accordingly, not to hook into the front side plate 76, the belt region between the driven and driving rollers 63 and 67 needs to be manually lifted. However, it is extraordinarily difficult to entirely drawing the intermediate transfer belt 61 from the front side plate lifting the belt region. Especially, when a large size professional-use printer with an intermediate transfer belt 61 having a length of more than 1 meter and capable of handling mass printing is used, the above-described operation cannot be single-handedly done.

Then, according to a printer of one embodiment of the present invention, a holder composed of the front side plate 76 and the like movably holds the first and second assistant rollers 65 and 66 serving as a belt supporter to change the state to a belt detachment and attachment state beside the above-described states.

Figure 30:
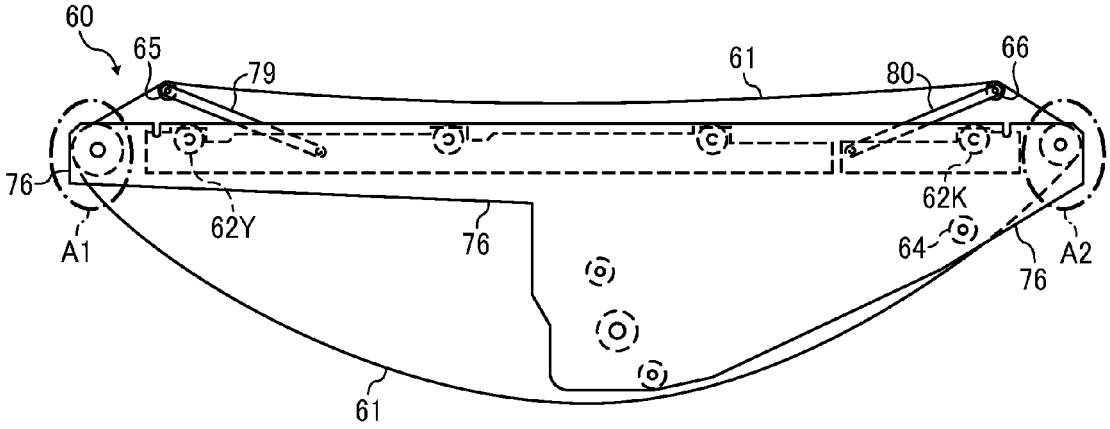
FIG. 30 is an enlarged front elevational view partially illustrating the transfer unit when the intermediate transfer belt has a belt detachment and attachment use posture.

Specifically, when having the intermediate transfer belt 61 to have the belt detachment and attachment state, the operator slightly swings the first arm 79 swingably supported by the first sub frame unit 77 clockwise thereby moving the first assistant roller 65 to diagonally upward left of the yellow primary transfer roller 62*y* as shown in FIG. 30. In this condition, the operator stops the first arm 79 at a position as shown in the drawing using a jig, not shown. Further, the operator also slightly swings the second arm 78 swingably supported by the second sub frame unit 78 counter clockwise thereby moving the second assistant roller 66 to diagonally upward right of the black primary transfer roller 62*k*. In this condition, the operator stops swinging of the second arm 80 at a position as shown in the drawing using a jig, not shown. Hence, the operator has the intermediate transfer belt 61 to have the belt attachment and detachment states.

In such a belt attachment and detachment state, almost all of a belt region between the driven roller 63 and the driving roller 67 is positioned higher than the front side plate 76 and does not hook thereinto. Specifically, only regions A1 and A2 in the vicinity of the driven roller 63 and the driving roller 67 can hook into the front side plate 76 among the entire circulation. However, the operator can readily pull out the intermediate transfer belt 61 currently having such a belt attachment and detachment state in the below described manner. Specifically, the operator initially only picks up and displaces the region A1 of the intermediate transfer belt 61 in the vicinity of the driven roller 63 to a position not to hook into the front side plate 76, and pulls it to the front side. Subsequently, the operator moves a front side end of the left half of the intermediate transfer belt 61 to the front side from the front side plate 76 in the drawing. Further, the operator only picks up and displaces the region A2 of the intermediate transfer belt 61 in the vicinity of the driving roller 67 to a position not to hook into the front side plate 76 and pulls it to the front side. The operator then moves a front side end of the right half of the intermediate transfer belt 61 to the front side from the front side plate 76 in the drawing. Hence, the entire circumference of the front side end of the intermediate transfer belt 61 is moved to the front side from the front side plate 76. After that, by pinching and pulling the vicinity of the left and right ward center of the intermediate transfer belt 61 in the drawing, it can be readily pulled out from the front side plate 76.

Now, a modification of the above-described embodiment is described. Due to an error in parallelism, an eccentricity, or a variation of a diameter at both sides of various support rollers and the like, the intermediate transfer belt 61 and accordingly the intermediate transfer belt 61 tend to deviate to one side end in the lateral direction thereof in the transfer unit 60. To suppress such a problem, it is known that an intermediate transfer belt includes a pair of deviation prevention ribs at both sides in the belt lateral direction, respectively. Specifically, the deviation prevention rib collides with a side end of a roller section of a belt support roller to suppress the deviation of the belt traveling with the deviation. However, such an intermediate transfer belt has a shorter life than that without the ribs, because the intermediate transfer belt with the ribs receives large load when the deviation prevention ribs collide with the side end of the roller section.

Further, for the same purpose, it is also known that an image forming apparatus employs a steering roller inclining within a belt loop of the intermediate transfer belt 61 to apply a deviated force to an opposite direction to that of the deviation thereof to avoid such belt deviated traveling without using the ribs. Then, the modification employs such a steering roller to correct belt deviation of the intermediate transfer belt 61.

Figure 31:
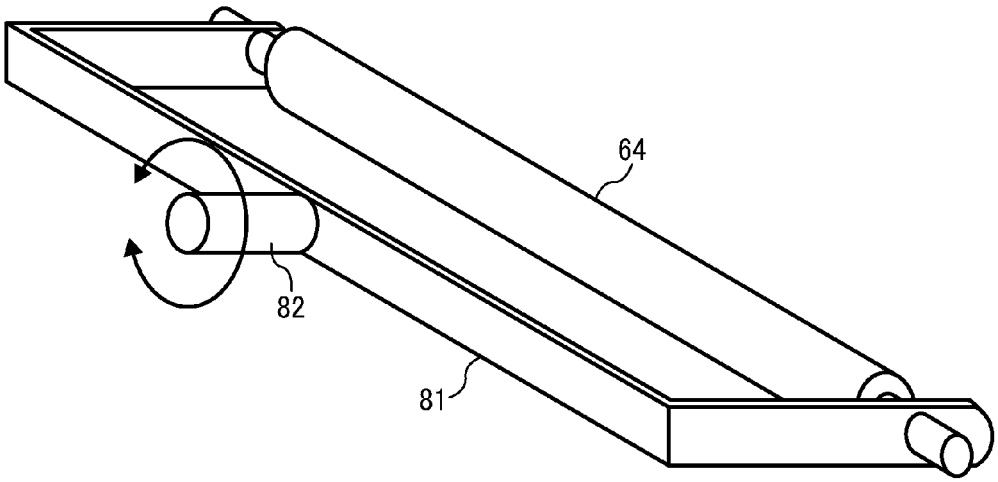
FIG. 31 is a perspective view illustrating a steering roller arranged within the loop of the intermediate transfer belt.

Now, the steering roller 64 inclining within the loop of the intermediate transfer belt is described with reference to FIG. 31. As shown, a shaft protruding from both sides in a rotary axis direction of the steering roller 64 is freely rotatavely supported by a steering arm 81. Further, a rotary shaft 82 driven and rotated by a driving mechanism, not shown, is attached to the steering arm 81. Thus, by rotating the rotary shaft 82 and accordingly inclining the steering roller 64 supported by the steering arm 81 in a prescribed direction, belt deviation is corrected.

As a result, comparing with a system having the deviation prevention ribs, a frequency of replacement of the intermediate transfer belt 61 can be decreased. By contrast, a frequency of maintenance to only replace inner parts installed in the belt loop while continuously using the intermediate transfer belt 61 may be increased. As a result, an advantage of the embodiment of the present invention can be effectively obtained, because the inner parts installed in the belt loop can be readily maintained while using the same intermediate transfer belt 61 continuously. Further, since roller sections of the primary transfer rollers 62*y*, 62*m*, 62*c*, and 62*k* are generally made of electrically conductive resin to have a prescribed electric resistance, which generally deteriorates as time elapses, their lives are relatively short. However, according to one embodiment of the present invention, since the assistant rollers 65 and 66 arranged adjacent to the primary transfer rollers are moved to enable the intermediate transfer belt 61 to have the first to fourth detachment and attachment states to upgrade the replaceability of the primary transfer rollers, a replacing workability of the primary transfer rollers having the shortest life can be upgraded without employing private use parts for changing a state of the intermediate transfer belt.

Hence, according to one embodiment of the present invention, by moving the first and second assistant rollers 65 and 66 serving as transfer roller adjacent members and lifting the belt opening not to be covered by the front and rear side plates to provide states, performance of detachment and attachment of the primary transfer rollers 62*y*, 62*m*, 62*c*, and 62*k* from and to the loop of the intermediate transfer belt 61 is upgraded more than those obtained in the full-color, monochrome, and unit detachment states. Specifically, the first to fourth detachment and attachment states are employed as transfer roller detachment and attachment states to detach and attach the primary transfer rollers. Accordingly, with such a configuration, by providing such detachment and attachment states, the primary transfer rollers 62*y*, 62*m*, 62*c*, and 62*k* can be precisely detached and attached improving its performance.

Further, according to one embodiment, the tension roller 71 is detachably attached to the front and rear side plates 76 and 76' to provided tension to the intermediate transfer belt 61 by contacting the front surface of the intermediate transfer belt 61 from the outside of the loop thereof. Accordingly, by detaching the tension roller 71 to loose the tension and partially lifting the intermediate transfer belt 61 from the inside to the outside of the loop thereby providing the first to fourth detachment and attachment states, visibility and accessibility of hand to the primary transfer rollers 62*y*, 62*m*, 62*c*, and 62*k* arranged within the loop can be upgraded. Specifically, by lifting a part of the entire intermediate transfer belt with such a simple system, the first to fourth detachment and attachment states thereof can be obtained.

According to one embodiment of the resent invention, the holder composed of the front and rear side plates 76 and 76', the first and second sub frame units, the first and second arms 79 and 80 or the like movably holds the first ad second assistant rollers 65 and 66 to provide the belt detachment and attachment state in addition to the full-color and monochrome printing states (i.e., use state), the detachment state, and the transfer roller detachment and attachment states (i.e., the first to fourth detachment and attachment states). Further, the belt detachment and attachment state provides better performance of the detachment and attachment than in the first to fourth postures. As a result, the intermediate transfer belt 61 rarely hooks into the front side plate 76 while suppressing damage thereon possibly caused by the hooking thereof.

Further, according to one embodiment of the present invention, the belt detachment and attachment state is created by detaching the tension roller 71 from the front and rear side plates 76 and 76' and lifting the thus relaxed intermediate transfer belt 61 at multiple sections along the belt circular direction from the inside to the outside of the loop thereof to upgrade the performance of the detachment and attachment thereof from and to a belt unit body composed of the front side plate 76 or the like. Therefore, with such a configuration, by lifting the intermediate transfer belt 61 at multiple sections, the performance of the detachment and attachment thereof can be more upgraded than when lifting only one section thereof. Because, relaxation of the intermediate transfer belt 61, needed in spreading out the intermediate transfer belt wider than the front side plate 81, can uniformly goes around in its circular direction.

Further, since the slide supporter composed of the rail 86 and the pulley 87 or the like slidably supporting the transfer unit 60 is provided within the printer housing, the transfer unit 60 can be single-handedly pulled out and gets ready for its maintenance at an outside of the printer housing.

Further, the deviation correction device composed of the steering arm and the rotary shaft 82 or the like with only the steering roller 64 being inclined to the other belt support rollers is provided to suppress deviation of the intermediate transfer belt 61. Accordingly, as described above, various inner parts installed in the loop can be readily maintained.

Although only the primary transfer roller is a detachment objective in the above-described various embodiments because of its shortest life among those disposed within the belt loop, the other interior parts, such as a belt supporting roller, etc., other than the primary transfer roller can be detached by similarly loosening the belt and detaching the belt unit as described heretofore.

Numerous additional modifications and variations of the present invention are possible in light of the above teachings. It is therefore to be understood that within the scope of the appended claims, the present invention may be practiced otherwise than as specifically described herein.

What is claimed is:

1. A belt unit detachably attachable to a housing of an image forming apparatus, the belt unit comprising:

an endless belt stretched in a looped state having openings in its lateral sides;

front and rear side plates between which the endless belt is disposed; and a holder comprising at least two belt supporters provided between the front and rear side plates within the loop of the endless belt to stretch and support the endless belt, the at least two belt supporters including:

at least one transfer roller movably held on the holder to apply a transfer bias to a rear side surface of the endless belt and transfer a toner image borne on a surface of an image bearer provided in the image forming apparatus onto one of a surface of the endless belt and a recording medium held by the endless belt; and at least one transfer roller adjacent supporter arranged adjacent to the transfer roller to independently move from the transfer roller, wherein the holder changes a state of tension of the endless belt by moving the at least one transfer roller between a first state and a second state, the first state allowing the endless belt to circulate for image formation, the second state allowing the belt unit to be detached from the housing, wherein the holder is configured to move the at least one transfer roller adjacent supporter independently of the at least one transfer roller and lift the opening in the endless belt to a prescribed position to expose it from the front side plate in a third state, the third state enabling detachment and attachment of the at least one transfer roller to and from the loop of the endless belt.

2. The belt unit as claimed in claim 1, further comprising a drawer to slidably draw the holder from the housing.

3. The belt unit as claimed in claim 1, wherein the at least two belt supporters include a steering roller to correct deviation of the endless belt by inclining the steering roller.

4. The belt unit as claimed in claim 1, further comprising:

at least one tension roller detachably attached to the belt unit to provide tension to a front surface of the endless belt from an exterior surface of the loop thereof, wherein the third state is created by detaching the at least one tension roller from the belt unit and decreasing the tension of the endless belt and partially lifting the endless belt with the at least one transfer roller adjacent supporter from an inside to an exterior surface of the loop thereof to expose the at least one transfer roller.

5. The belt unit as claimed in claim 1, further comprising at least one tension roller detachably attached to the belt unit to provide tension to a front surface of the endless belt from an exterior surface of the loop thereof, wherein the at least two belt supporters include at least one interior part, wherein the holder independently movably holds the transfer roller adjacent supporter and to achieve a fourth state allowing detachment and attachment of the at least one interior part from and to the loop of the endless belt.

6. The belt unit as claimed in claim 5, wherein the fourth state is created by detaching the at least one tension roller from the belt unit and decreasing the tension of the endless belt while partially lifting the endless belt from an inside to an exterior surface of the loop thereof to expose the at least one interior part.

7. The belt unit as claimed in claim 6, wherein the holder independently movably holds the at least one transfer roller adjacent supporter and achieves a fifth state allowing detachment and attachment of the endless belt from and to the belt unit.

8. The belt unit as claimed in claim 7, wherein the holder movably holds at least two transfer roller adjacent supporters independently of the at least two transfer rollers, wherein the fifth state is created by detaching the at least two tension rollers from the belt unit and decreasing the tension of the endless belt while partially lifting the endless belt at at least two positions thereof by moving the at least two transfer roller adjacent supporters from an inside to an exterior surface of the loop thereof.

9. An image forming apparatus comprising:

an image formation device to form an image on a recording medium; and a belt system to circulate an endless belt with the recording medium held thereon, the belt system including a belt unit detachably attachable to a housing of the image forming apparatus and comprising:

an endless belt stretched in a looped state having openings in its lateral sides;

front and rear side plates between which the endless belt is disposed; and a holder comprising at least two belt supporters provided between the front and rear side plates within the loop of the endless belt to stretch and support the endless belt, the at least two belt supporters including:

at least one transfer roller movably held on the holder to apply a transfer bias to a rear side surface of the endless belt and transfer a toner image borne on a surface of an image bearer provided in the image forming apparatus onto one of a surface of the endless belt and a recording medium held by the endless belt; and at least one transfer roller adjacent supporter arranged adjacent to the transfer roller to independently move from the transfer roller, wherein the holder changes a state of tension of the endless belt by moving the at least one transfer roller between a first state and a second state, the first state allowing the endless belt to circulate for image formation, the second state allowing the belt unit to be detached from the housing, wherein the holder is configured to move the at least one transfer roller adjacent supporter independently of the at least one transfer roller and lift the opening in the endless belt to a prescribed position to expose it to the front side plate in a third state, the third state enabling detachment and attachment of the at least one transfer roller to and from the loop of the endless belt.

10. A belt unit detachably attached to a housing of an image forming apparatus, the belt unit comprising:

an endless belt stretched in a looped state having openings in its lateral sides; and means for holding at least two belt supporting means between front and rear side plates within the loop of the endless belt to stretch and support the endless belt, the at least two belt supporting means including:

at least one transfer means movably held on the holder for applying a transfer bias to a rear side surface of the endless belt and transferring a toner image borne on a surface of an image bearer provided in an image forming apparatus onto one of a surface of the endless belt and a recording medium held by the endless belt; and at least one transfer means adjacent supporter means arranged adjacent to the transfer means for independently moving from the transfer means, wherein the holding means changes a state of the endless belt by moving the at least one transfer means between a first state and a second state, the first state allowing the endless belt to circulate for image formation, the second state allowing the belt unit to be detached from the housing, wherein the holding means is configured to move the at least one transfer meaning adjacent supporter means independently of the at least one transfer means and lift the opening in the endless belt to a prescribed position to expose it to the front side plate as a third state, the third state enabling detachment and attachment of the at least one transfer means to and from the loop of the endless belt.

11. The belt unit as claimed in claim 10, further comprising means for drawing the holder from the housing.

12. The belt unit as claimed in claim 10, wherein the at least two belt supporting means include means for correcting deviation of the endless belt by inclining a steering roller.

13. The belt unit as claimed in claim 10, further comprising:

at least one tension means detachably attached to the belt unit for providing tension to a front surface of the endless belt from an exterior surface of the loop thereof, wherein the third state is created by detaching the tension providing means from the belt unit and decreasing the tension of the endless belt while partially lifting the endless belt with the at least one transfer means adjacent supporter means from an inside to an exterior surface of the loop thereof to expose the at least one transfer means.

14. The belt unit as claimed in claim 10, further comprising at least one tension means detachably attached to the belt unit for providing tension to a front surface of the endless belt from an exterior surface of the loop thereof, wherein the at least two belt supporting means includes at least one interior part, wherein the holding means provides a fourth state allowing detachment and attachment of the at least one interior part from and to the loop of the endless belt.

15. The belt unit as claimed in claim 14, wherein the fourth state is created by detaching the at least one tension means from the belt unit and decreasing the tension of the endless belt while partially lifting the endless belt from an inside to an exterior surface of the loop thereof to expose the at least one interior part.

16. The belt unit as claimed in claim 10, wherein the holding means provides a fifth state allowing detachment and attachment of the endless belt from and to the belt unit.

17. The belt unit as claimed in claim 16, wherein the holding means movably holds at least two transfer means adjacent supporter means independently of the at least two transfer means, wherein the fifth state is created by detaching the at least two tension means from the belt unit and decreasing the tension of the endless belt while partially lifting the endless belt at at least two positions thereof by moving the at least two transfer means adjacent supporter means from an inside to an exterior surface of the loop thereof.

* * * * *